US010087035B2

(12) United States Patent
Hama et al.

(10) Patent No.: US 10,087,035 B2
(45) Date of Patent: Oct. 2, 2018

(54) SHEET POST-PROCESSING DEVICE WHICH FOLDS A CONVEYED SHEET AT TWO OR MORE POSITIONS

(71) Applicant: Konica Minolta, Inc., Chiyoda-ku, Tokyo (JP)

(72) Inventors: Riichi Hama, Toyokawa (JP); Takuya Inoue, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 253 days.

(21) Appl. No.: 15/158,077

(22) Filed: May 18, 2016

(65) Prior Publication Data

US 2016/0340146 A1 Nov. 24, 2016

(30) Foreign Application Priority Data

May 20, 2015 (JP) ..... 2015-102456

(51) Int. Cl.
*B65H 45/14* (2006.01)
*B31F 1/00* (2006.01)
(Continued)

(52) U.S. Cl.
CPC ..... *B65H 45/14* (2013.01); *B31F 1/0022* (2013.01); *B65H 29/125* (2013.01); *B65H 45/18* (2013.01);
(Continued)

(58) Field of Classification Search
CPC ..... B65H 45/14; B65H 29/125; B65H 45/18; B31F 1/0022; G03G 15/6582
See application file for complete search history.

(56) References Cited

U.S. PATENT DOCUMENTS 7,040,612 B2 * 5/2006 Garner ..... B65H 45/18 270/39.08
7,503,886 B2 * 3/2009 Sekine ..... B65H 29/58 493/424
(Continued)

FOREIGN PATENT DOCUMENTS

JP 2014-238201 A 8/2004
JP 2007-022693 A 2/2007
(Continued)

OTHER PUBLICATIONS

Notice of Reasons for Refusal issued in corresponding Japanese Patent Application No. 2015-102456, dated May 23, 2017, with English Translation (9 pages).

*Primary Examiner* — Patrick H Mackey
(74) *Attorney, Agent, or Firm* — Buchanan Ingersoll & Rooney PC

(57) ABSTRACT

A folding processing unit in a sheet post-processing device comprises a first conveying path, upstream side conveying rollers, downstream side conveying rollers, folding rollers between the upstream side conveying rollers and the downstream side conveying rollers, and the second folding rollers. The folding rollers fold a sheet at the first nip portion between the two rollers. The second folding rollers are placed at a downstream side of the first nip portion. An edge face detection sensor for detecting the edge face of the sheet is placed on the first conveying path, at a downstream side of the first nip portion. The second folding rollers pinch the sheet folded by the first nip portion at the second nip portion, to further fold the sheet, based on the detection result of the edge face detection sensor. Herewith, degree of accuracy for folding behavior improves.

8 Claims, 15 Drawing Sheets

(51) Int. Cl.
*B65H 29/12* (2006.01)
*B65H 45/18* (2006.01)
*G03G 15/00* (2006.01)

(52) U.S. Cl.
CPC ... *G03G 15/6582* (2013.01); *B65H 2403/942* (2013.01); *B65H 2511/13* (2013.01); *B65H 2513/53* (2013.01); *B65H 2701/11232* (2013.01); *B65H 2701/1311* (2013.01); *B65H 2801/27* (2013.01)

(56) References Cited

U.S. PATENT DOCUMENTS

| | | | | |
|---|---|---|---|---|
| 8,387,964 | B2 * | 3/2013 | Saito | B65H 45/18 270/32 |
| 9,682,841 | B2 * | 6/2017 | Tsunoda | B65H 45/18 |
| 2015/0217964 | A1 * | 8/2015 | Kugimiya | B65H 45/18 493/444 |
| 2015/0336765 | A1 * | 11/2015 | Sawada | B65H 45/14 493/434 |
| 2017/0205751 | A1 * | 7/2017 | Hirano | G03G 15/6582 |

FOREIGN PATENT DOCUMENTS

| | | | |
|---|---|---|---|
| JP | 2014/118241 | A | 6/2014 |
| JP | 2014-125312 | | 7/2014 |
| JP | 2014125312 | A * | 7/2014 |

* cited by examiner

SHEET POST-PROCESSING DEVICE WHICH FOLDS A CONVEYED SHEET AT TWO OR MORE POSITIONS

This application is based on Japanese Patent Application No. 2015-102456 filed with the Japan Patent Office on May 20, 2015, the entire content of which is hereby incorporated by reference.

BACKGROUND OF THE INVENTION

Field of the Invention

This invention relates to a sheet post-processing device and an image forming apparatus. More specifically, this invention relates to a sheet post-processing device and an image forming apparatus which folds a conveyed sheet at two or more positions.

Description of the Related Art

Conventionally, sheet post-processing devices which convey sheets and perform post-processing on the sheets being conveyed are used. Such a sheet post-processing device is used for performing post-processing on sheets on which images were formed, in an image forming apparatus, for example.

Some kind of sheet post-processing device can fold a sheet at two or more positions by using a pair of folding rollers or the like, as post-processing. For example, to perform Z-folding, outer threefold, inner threefold, or the like, the first folding is performed at the first folding position, and the second folding is performed at the second folding position.

The Document 1 below discloses a structure of a post-processing device which performs printing or stapling at the folding position. The device detects the printing or stapling to determine the folding position.

The Document 2 below discloses a sheet folding device which determines the first folding position, based on conveying rollers at the upstream side and at the downstream side of the folding location and a sensor installed at downstream of the downstream conveying roller, to improve the accuracy of the first folding position. The second folding position is decided by detecting the leading end of the first folded portion, by using a sensor installed at a branched path.

The Document 3 below discloses a structure of a sheet process device which performs the second folding by feeding the upstream sheet, pinching the sheet after the first folding by a pair of the second rollers which is installed interposing the conveying path. The sheet process device detects an edge face of the sheet by a sensor installed at upstream of the pair of the second rollers. In response to the result, the first folding position and the second folding position are decided.

[Document 1] Japan Patent Publication No. 2004-238201

[Document 2] Japan Patent Publication No. 2014-118241

[Document 3] Japan Patent Publication No. 2007-22693

When a sheet post-processing device performs folding, an error of the folding position may generally occur. Such an error is caused by variation in the feeding amount of rollers which move a sheet to the folding position, a deflection of a sheet which occurs in a conveying path, variation in the friction coefficient of a folding roller, variation in stiffness which occurs by the difference in quality of sheet material and the difference in basis weight, variation in the friction coefficient of a sheet which occurs by quality of sheet material, or the like.

Hence, when post-processing is performed by a mode of Z-folding or the like, in which a sheet is folded at two positions in series, by using such as a method of the sheet folding device disclosed by the Document 2, problems may be developed.

FIG. 15 is for explanation pertaining to an error of the folding position, when Z-folding is performed conventionally.

Referring to FIG. 15, the occurrence of an error of the folding position when Z-folding is performed will be explained, for example. More specifically, in this instance, the first folding is performed after detecting the location of a sheet, on the basis of leading end E1 of the sheet. The second folding is performed after detecting the location of the sheet, on the basis of the leading end of the first folding position F1 which was made by the first folding. Then, the error (variation) D2 of the second folding position F2 at which the second folding is performed includes the error D1 of the first folding position F1 occurred when the first folding was performed. Since the errors are accumulated for the second folding position F2, the error D2 of the second folding position F2 is large, when compared to the error D1 of the first folding position.

An effective solution to the problem is not disclosed in the above mentioned Documents 1 and 3.

According to the method disclosed in the Document 3, the location of the end of the sheet is detected, and the first folding position is decided. After that, the second folding position is decided, based on an amount of drawing by the pair of rollers when the first folding and an amount of pushing into the pair of rollers which performs the second folding. Therefore, the error occurred at the first folding position is accumulated in the error of the second folding position.

According to the method disclosed in the Document 1, a mark should be printed on the sheet. Therefore, another problem of degradation in appearances of the sheets is developed. Further, the method wherein the folding position is decided by using a staple as a sign can not be adopted when one sheet is folded.

This invention is to solve the above problems. The object is to provide a sheet post-processing device and an image forming apparatus which can fold a sheet with precision.

SUMMARY OF THE INVENTION

According to one aspect of the invention, a sheet post-processing device which folds a sheet conveyed, at two or more positions, comprises: a first conveying path on which the sheet is conveyed, an upstream side conveying roller installed along with the first conveying path, for conveying the sheet, a downstream side conveying roller installed at a downstream side of the upstream side conveying roller on the first conveying path, along with the first conveying path, for conveying the sheet, a first edge face detection unit for detecting an edge face of the sheet being conveyed on the first conveying path, a first folding unit for folding the sheet by pinching the sheet at a first nip portion between two rollers, at the location between the upstream side conveying roller and the downstream side conveying roller on the first conveying path, based on the detection result of the first edge face detection unit, a second conveying path to which a folded leading end of the sheet folded by the first folding unit is fed, wherein the second conveying path is installed branching off from the first conveying path, a second edge face detection unit for detecting the edge face of the sheet, at a downstream side of the first nip portion on the first conveying path, and a second folding unit for further folding the sheet by pinching the sheet folded by the first folding unit, at a second nip portion between two rollers, at a location of a downstream side of the first nip portion on the first conveying path or a location on the second conveying path, based on detection result of the second edge face detection unit.

According to another aspect of the invention, an image forming apparatus comprises: a receiving unit for receiving an execution instruction for folding behavior from a user, an image fog fining unit for forming images on a sheet, and a sheet post-processing device for folding the sheet on which images were formed by the image forming unit, at least two positions, based on the execution instruction received by the receiving unit, wherein the sheet post-processing device comprises: an acquire unit for acquiring size information of the sheet on which images were formed by the image forming unit, a first conveying path on which the sheet is conveyed, an upstream side conveying roller installed along with the first conveying path, for conveying the sheet, a downstream side conveying roller installed at a downstream side of the upstream side conveying roller on the first conveying path, along with the first conveying path, for conveying the sheet, a first edge face detection unit for detecting an edge face of the sheet being conveyed on the first conveying path, a first folding unit for folding the sheet by pinching the sheet at a first nip portion between two rollers, at the location between the upstream side conveying roller and the downstream side conveying roller on the first conveying path, based on the detection result of the first edge face detection unit and the size information acquired by the acquire unit, a second conveying path to which a folded leading end of the sheet folded by the first folding unit is fed, wherein the second conveying path is installed branching off from the first conveying path, a second edge face detection unit for detecting the edge face of the sheet, at a downstream side of the first nip portion on the first conveying path, and a second folding unit for further folding the sheet by pinching the sheet folded by the first folding unit, at the second nip portion between two rollers, at a location of a downstream side of the first nip portion on the first conveying path or a location on the second conveying path, based on detection result of the second edge face detection unit and the size information acquired by the acquire unit.

DESCRIPTION OF THE PREFERRED EMBODIMENTS

Figure 1:
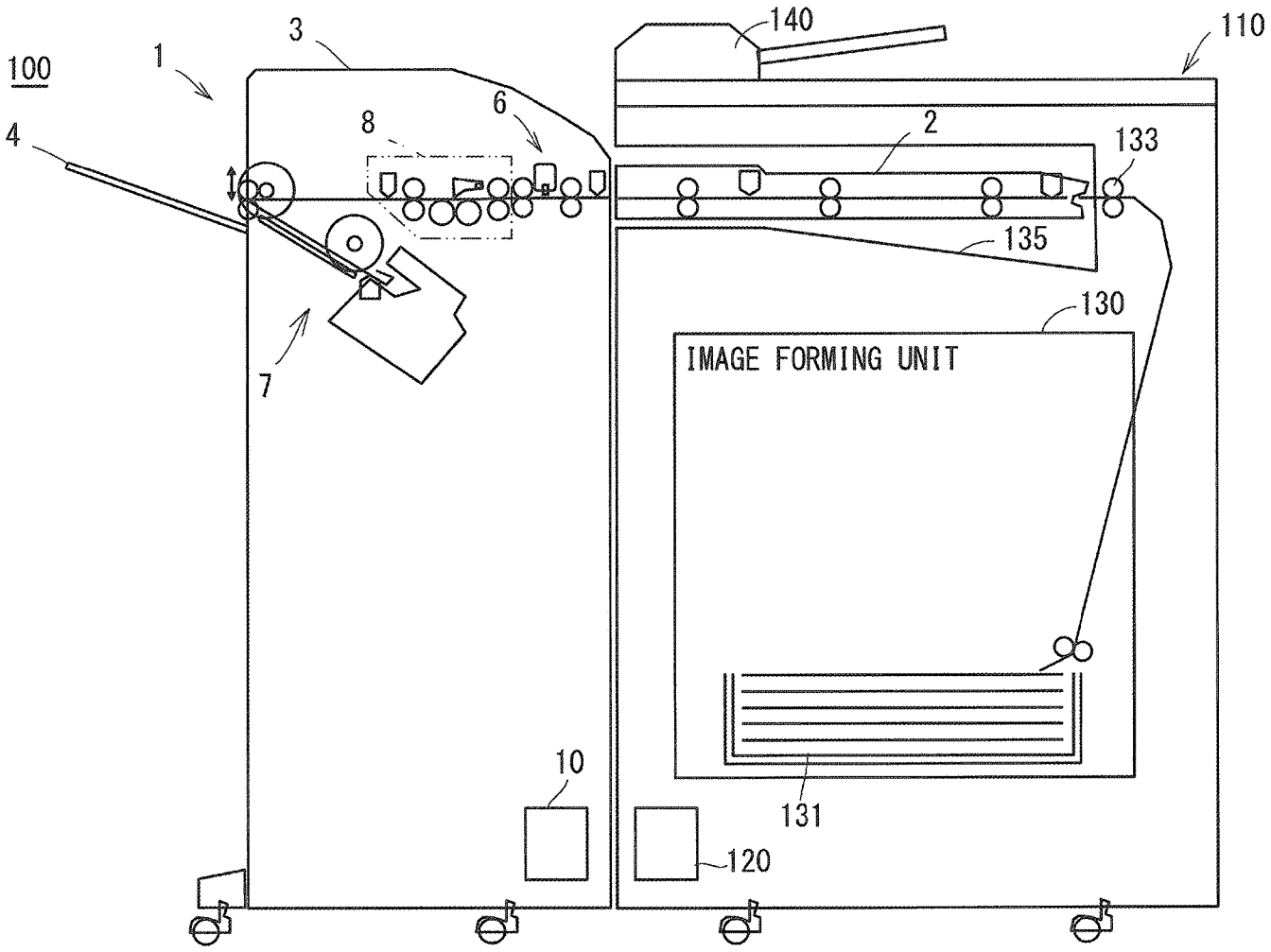
FIG. 1 shows a side view of an image forming apparatus equipped with a sheet post-processing device, according to an embodiment of this invention.

A sheet post-processing device, according to the embodiment of this invention will be explained in the followings.

[Overview]

A sheet post-processing device is used with a main body of an image forming apparatus. The main body of the image forming apparatus is an MFP (Multi Function Peripheral) which has a scanner function, a copying function, a function of a printer, a facsimile function, a data transmitting function, and a server function, for example. The scanner function is to read images of documents which were set, and to accumulate the read images in a HDD (Hard Disk Drive) or the like. The copying function is to print the read images on sheets or the like. The function of a printer is to perform printing on sheets, based on a printing instruction which was received, after receiving the instruction from an external terminal such as a PC. The facsimile function is to receive facsimile data from an external facsimile device or the like and accumulate the data in a HDD or the like. The data transmitting function is to transmit and receive data with a connected external device. The server function is to make data stored in the HDD or the like sharable among a plurality of users. Users can combine the main body of the image forming apparatus and the sheet post-processing device, to use them as one image forming apparatus.

The sheet post-processing device conveys sheets which were discharged from the main body of the image forming apparatus one by one, and performs post-processing (sheet process) on the sheets conveyed. The post-processing is performed based on execution instructions of a user. More specifically, the image forming apparatus receives execution instructions of post-processing by a user, when receiving a printing job, for example. When receiving the execution instructions, based on the instructions, the sheet post-processing device performs post-processing on sheets on which images were formed by the image forming unit, and discharges the sheets.

As post-processing, a folding process (folding behavior) to fold a sheet at two positions is performed, for example. The folding behavior is performed as the followings. More specifically, the first folding is performed at the first folding position of the sheet. Next, the second folding is performed at the second folding position of the sheet. After the second folding, the sheet is conveyed and discharged. As folding behavior, so-called Z-folding, inner threefold, and outer threefold can be performed, for example. The post-processing can be performed wherein the sheet is folded, to be able to unfold the sheet outwardly. The post-processing can be performed by other methods in which the sheet is folded two or more times, for example.

According to the embodiment, the folding behavior is performed by conveying rollers which are installed at both an upstream side and a downstream side, a pair of the first folding rollers which are installed adjacent to the sheet conveying path between the conveying rollers, and a pair of the second folding rollers interposing the sheet conveying path between the second folding rollers at a downstream side of the first folding rollers. A sheet edge face detection sensor for detecting the leading end of the sheet is provided at a downstream side of a nip portion of the first folding roller, on the sheet conveying path. The sheet edge face detection sensor detects the leading end of the sheet, before the first folding, and between the time of the first folding and the time of the second folding. The first folding position and the second folding position are decided, in response to the detection result of the leading end of the sheet. Therefore, an error of the second folding position is the error caused by only one folding behavior. According to the embodiment, the first folding and the second folding are performed with high precision.

[Embodiments]

FIG. 1 shows a side view of an image forming apparatus equipped with a sheet post-processing device, according to an embodiment of this invention.

The sheet post-processing device 1 is used with the main body of the image forming apparatus 110. A user can use sheet post-processing device 1 as image forming apparatus 100 which includes the main body of the image forming apparatus 110. In other words, image forming apparatus 100 is sheet post-processing device 1 which has image forming function performed by the main body of the image forming apparatus 110.

[Structure of the Main Body of the Image Forming Apparatus 110]

The main body of the image forming apparatus 110 is equipped with control unit 120, image forming unit 130, image reading device 140, and so on.

Control unit 120 controls behavior of each portion of the main body of the image forming apparatus 110. The specific structure of control unit 120 will be explained later.

The image forming unit 130 conveys sheets loaded in sheet cartridge 131 or the like, in the inner part of the main body of the image forming apparatus 110, with forming images on the sheet. Image forming unit 130 forms images by using electrophotographic technology, ink jet method, or the like. Sheets on which images were formed by the image forming unit 130 are sent forth by main body discharge roller 133, from the main body of the image forming apparatus 110 to copy receiving tray 135 installed at an upper part of the main body of the image forming apparatus 110.

Image reading device 140 reads documents put at the predetermined location of image reading device 140, by using the image pickup apparatus, and outputs the image data. Image reading device 140 can read documents with conveying the documents by an ADF (Auto Document Feeder), or the like. Image reading device 140 scans a document placed on a platen installed on the upper surface of the main body of the image forming apparatus 110 by using the image pickup apparatus, to read the document.

Figure 2:
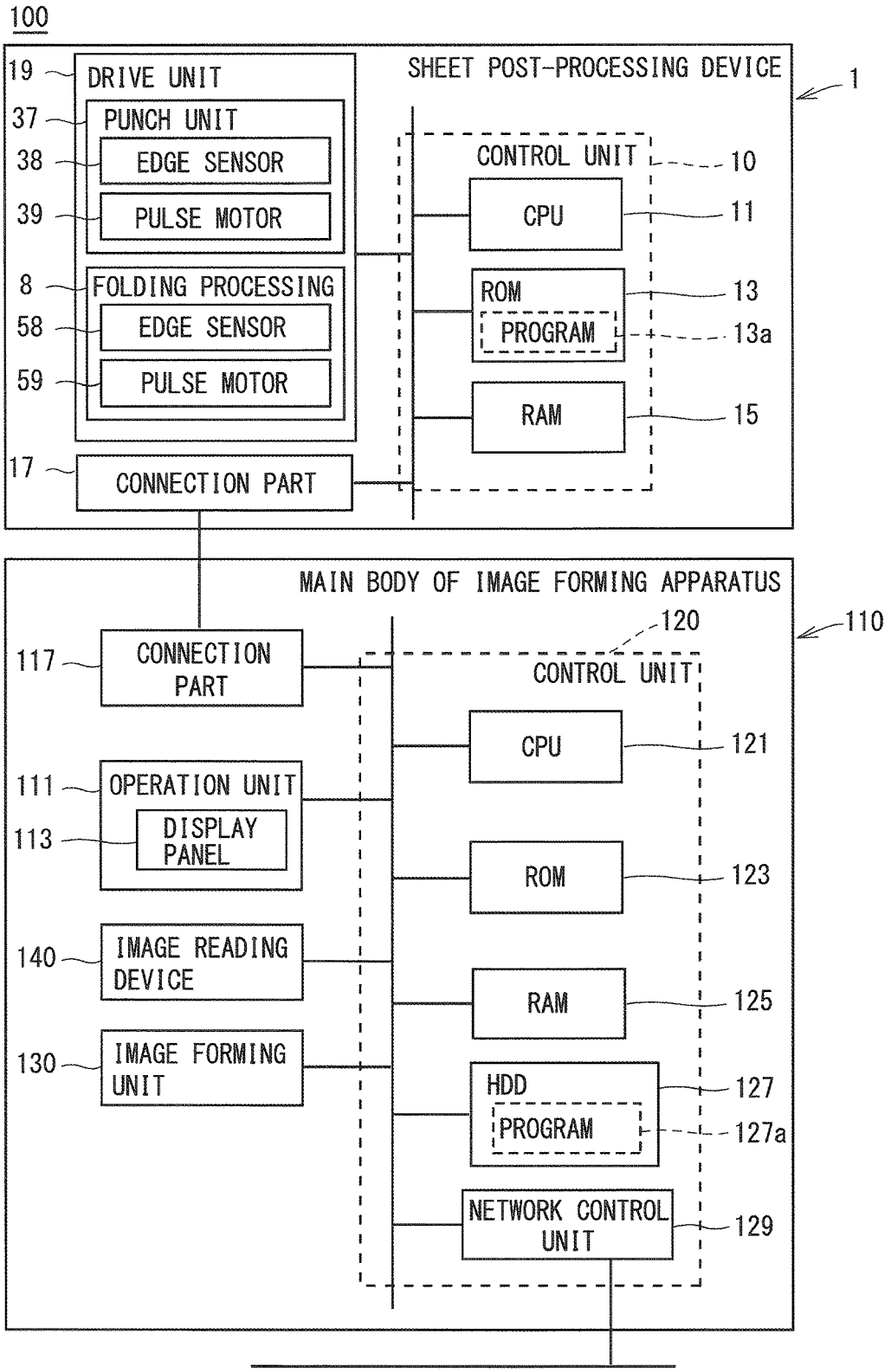
FIG. 2 shows a block diagram of the image forming apparatus.

FIG. 2 shows a block diagram of the image forming apparatus 100.

Referring to FIG. 2, the main body of the image forming apparatus 110 further comprises an operation unit (an example of a receiving unit) 111, and sheet post-processing device connection part 117.

Control unit 120 comprises CPU 121, ROM 123, RAM 125, HDD 127, and network control unit 129. Control unit 120 is connected with the system bus, along with operation unit 111, sheet post-processing device connection part 117, image forming unit 130, image reading device 140, and so on. Herewith, control unit 120 is connected with the each part of the main body of the image forming apparatus 110, to receive and send signals.

HDD 127 stores job data transmitted from the outside via network control unit 129, image data read by image reading device 140, and so on. HDD 127 stores setting information of the main body of the image forming apparatus 110, control programs (program) 127*a* to execute various sorts of behavior of the main body of the image forming apparatus 110, and so on. HDD 127 can store a plurality of jobs transmitted from one client PC, a plurality of client PCs, or the like.

Network control unit 129 is configured with a hardware unit such as a NIC (Network Interface Card) or the like, and a software unit combined with the hardware unit, which performs communication under the predetermined communication protocol. Network control unit 129 connects the main body of the image forming apparatus 110 to external networks such as LANs. Herewith, the main body of the image forming apparatus 110 can communicate with external devices such as client PCs which are connected with external networks. The main body of the image forming apparatus 110 can receive printing jobs via external networks, and transmit image data read by image reading device 140. Network control unit 129 may be configured to connect with external networks by wireless communication.

CPU 121 controls various sorts of behavior of the main body of the image forming apparatus 110, by executing control program 127*a* or the like stored in ROM 123, RAM 125, HDD 127, or the like. When operation signals are sent from operation unit 111 or operation commands are transmitted from an external PC or the like, CPU 121 executes predetermined control program 127*a* in response to the signals and commands. Herewith, the predetermined function of the main body of the image forming apparatus 110 is performed, in response to operation or the like of operation unit 111 by a user.

ROM 123 is a flash ROM (Flash Memory), for example. ROM 123 stores data to be used for performing behavior of the main body of the image forming apparatus 110. ROM 123 may not be rewritable.

RAM 125 is a main memory for CPU 121. RAM 125 is used for storing data needed for execution of control program 127*a* by CPU 121.

Operation unit 111 is placed on a chassis of the main body of the image forming apparatus 110, to be operated by a user. On operation unit 111, a plurality of operation buttons which can be push-operated by a user, display panel 113, and so on are placed. Display panel 113 is an LCD (Liquid Crystal Display) which includes a touch panel, for example. Display panel 113 displays a guide screen for a user, and displays operation buttons to receive touch operations from a user. Display panel 113 is controlled by CPU 121 to perform displaying. When the operation buttons or display panel 113 is operated by a user, operation unit 111 transmits the operation signals or predetermined commands which correspond to the operation, to CPU 121. More specifically, a user can make image forming apparatus 100 execute various sorts of behavior, by operating operation unit 111. Control unit 120 can receive operation input of the user via operation unit 111. A user can instruct to perform folding behavior using sheet post-processing device 1 as post-processing, for example. According to the instruction, control unit 120 performs control behavior. Herewith, post-processing by sheet post-processing device 1 is performed on a sheet on which images were formed by image forming unit 130.

Sheet post-processing device connection part 117 is provided, being able to connect with connection part 17 installed on sheet post-processing device 1 via a cable, a connector, or the like. Sheet post-processing device connection part 117 is configured by combining a hardware unit, and a software unit which communicates with sheet post-processing device 1 under predetermined communication protocol.

Since sheet post-processing device connection part 117 is connected with connection part 17, the main body of the image forming apparatus 110 works with sheet post-processing device 1, to be able to work as one image forming apparatus 100.

[Structure of Sheet Post-processing Device 1]

Referring back to FIG. 1, sheet post-processing device 1 roughly comprises horizontal conveying unit 2, processing unit main body 3, sheet tray 4, and control unit (an example of an acquire unit) 10. Processing unit main body 3 is provided with punch processing unit 6 to perform punch process (an example of post-processing), stapling processing unit 7 to perform side stitching as a stapling process (an example of post-processing), and folding processing unit 8 to perform a folding process (an example of post-processing), for example. For example, a saddle stitching processing unit to perform a saddle stitching process (an example of post-processing) can be provided. Sheets are conveyed by horizontal conveying unit 2 and processing unit main body 3. The sheets are conveyed to these processing units 6, 7, and 8.

Horizontal conveying unit 2 pulls sheets discharged from main body discharge roller 133 of the main body of the image forming apparatus 110 in sheet post-processing device 1, and conveys the sheets to processing unit main body 3 in the latter stage.

Processing unit main body 3 performs post-processing such as punch processing, sorting processing, stapling processing, and folding processing, on sheets fed out from horizontal conveying unit 2, and discharges the sheets on sheet tray 4. The punch processing is to make holes at predetermined points of each sheet, for example. The sorting processing is to assemble and discharge a plurality of sheets of each group at each location or each tray, in order to distinguish the sheets from other groups, for example. The stapling processing is to assemble and staple a plurality of sheets. The folding processing is to perform folding behavior, to fold one or more sheets.

Control unit 10 controls behavior of each part of sheet post-processing device 1, as described below.

Referring to FIG. 2, sheet post-processing device 1 further comprises connection part 17 and drive unit 19.

Control unit 10 comprises CPU 11, ROM 13, and RAM 15. Control unit 10, connection part 17, and drive unit 19 are connected with a system bus, to be able to communicate with each other. The various sensors mentioned below are connected with the system bus, to be able to communicate with control unit 10 or the like.

ROM 13 is a flash ROM (Flash Memory), for example. ROM 13 stores setting information for sheet post-processing device 1, and data to be used for performing behavior of sheet post-processing device 1. ROM 13 stores control programs (program) 13*a* to perform various sorts of behavior of sheet post-processing device 1.

RAM 15 is a main memory for CPU 11. RAM 15 is used to store data needed when CPU 11 executes control program 13*a*.

CPU 11 executes control program 13*a* stored in ROM 13 or the like, to control various sorts of behavior of sheet post-processing device 1. CPU 11 executes predetermined processes, to execute data reading from ROM 13 and data writing to ROM 13. ROM 13 may not be rewritable.

Drive unit 19 includes motors which work each part of sheet post-processing device 1, sensors for acquiring information for the work, and so on. More specifically, for example, drive unit 19 includes punch unit 37, folding processing unit 8, other drive motors, and so on. Drive unit 19 works based on control of control unit 10. Drive unit 19 conveys sheets and performs post-processing by driving horizontal conveying unit 2, processing unit main body 3, and so on.

Punch unit 37 is driven by pulse motor 39. Punch unit 37 is provided with paper edge detection sensor 38. Punch unit 37 detects the location of a sheet by paper edge detection sensor 38. Punch unit 37 moves to the location which corresponds to the location of the sheet by driving force of pulse motor 39, to execute processes of the punch on the sheet.

Folding processing unit 8 comprises paper edge detection sensor 58, pulse motor 59, and so on. Folding processing unit 8 drives pulse motor 59, to perform folding behavior on a sheet, based on the detection result of the edge face of the sheet by paper edge detection sensor 58.

Connection part 17 can connect with sheet post-processing device connection part 117 in the main body of the image forming apparatus 110. Connection part 17 is configured by combining a hardware unit being able to connect with a cable or a connector to be used to connect with sheet post-processing device connection part 117, and a software unit for communicating with the main body of the image forming apparatus 110 under predetermined communication protocol.

With connection part 17 connected with sheet post-processing device connection part 117, control unit 10 can communicate with control unit 120 of the main body of the image forming apparatus 110. The information of behavior state of the main body of the image forming apparatus 110 or the like is transmitted from control unit 120 to control unit 10. The information being transmitted is post-processing information, sheet information, or the like. The post-processing information is as for post-processing to be performed. The sheet information is information related to a sheet which was discharged from the main body of the image forming apparatus 110 and fed into sheet post-processing device 1. The sheet information includes the thickness of the sheet, the types and the size of the sheet, number of sheets being process objects at each action of post-processing, and so on. The information includes execution instructions by a user accepted by operation unit 111, information instructed by a user when the printing job is transmitted, and so on.

Control unit 10 receives information being transmitted from control unit 120. Control unit 10 drives drive unit 19 in response to the information, to control behavior of parts of sheet post-processing device 1. Control unit 10 transmits information as for behavior situation of sheet post-processing device 1 or the like to control unit 120. Herewith, the main body of the image forming apparatus 110 and sheet post-processing device 1 work with each other. For example, control unit 120 changes image forming timings of a plurality of sheets, so that post-processing is suitably performed at sheet post-processing device 1. Control unit 120 can perform controls, so that sheets are fed in sheet post-processing device 1, at proper distances.

Control unit 10 can work based on instructions input from operation unit 111 of the main body of the image forming apparatus 110, instructions transmitted from external devices connected with the main body of the image forming apparatus 110, and so on. Sheet post-processing device 1 may comprise an operation panel which can be operated by a user. Sheet post-processing device 1 may work based on instructions input from the operation panel.

Figure 3:
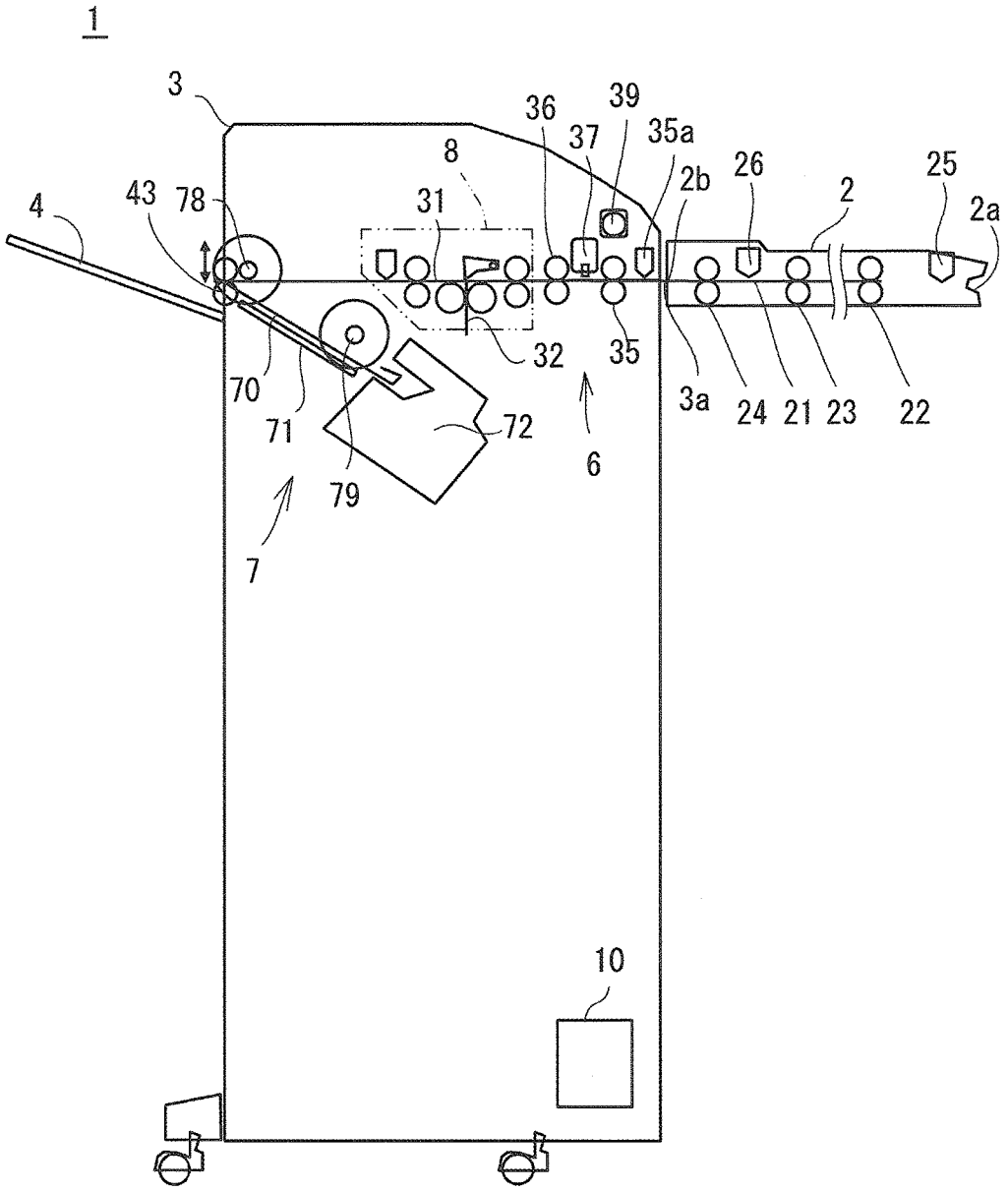
FIG. 3 shows a side view of the sheet post-processing device.

FIG. 3 shows a side view of the sheet post-processing device 1.

As shown by FIG. 3, horizontal conveying unit 2 comprises horizontal conveying path 21 which is a conveying path of sheets, three conveying rollers 22, 23 and 24, and sensors 25 and 26 which detect sheets.

Horizontal conveying path 21 is placed to connect carry-in port 2*a* of sheets and discharge outlet 2*b* for the sheets to processing unit main body 3, almost horizontally. Three conveying rollers 22, 23, and 24 are provided along with horizontal conveying path 21, from an upstream side (carry-in port 2*a* side) of horizontal conveying path 21 in order. The sheet discharged from main body discharge roller 133 of the main body of the image forming apparatus 110 is fed into the inner part of horizontal conveying unit 2 from carry-in port 2*a*. The sheet being fed is sent to processing unit main body 3, with conveying rollers 22 to 24 being driven.

Processing unit main body 3 roughly comprises the first conveying path 31 and the second conveying path 32, as sheet conveying paths. The first conveying path 31 is placed to connect carry-in port 3*a* of sheets, which is installed at an upper part of processing unit main body 3, and the sheet discharge outlet almost horizontally. The second conveying path 32 is placed at the middle of the first conveying path 31, branching off from the first conveying path 31. The second conveying path 32 is used when performing folding behavior, as described below. More specifically, when a sheet is to be folded, a part of the sheet is conveyed into the second conveying path 32 temporarily.

On the first conveying path 31, from the upstream side, punch processing unit 6 and folding processing unit 8 are placed. Punch processing unit 6 is provided with register sensor 35*a*, register roller 35, intermediate roller 36, and punch unit 37. Register sensor 35*a* detects a sheet fed into the first conveying path 31. Register roller 35 adjusts conveying timing of the sheet conveyed, and begins conveying again at predetermined timing. Punch unit 37 makes holes (executes punch processes) at predetermined points of the sheet being conveyed. Intermediate roller 36 conveys the sheet to the second conveying path 32.

Discharge roller 43 is provided at the downstream end of the first conveying path 31, namely near by sheet tray 4. Discharge roller 43 which includes a pair of rollers can control whether or not to discharge a sheet, by making the rollers contact with each other or separating the rollers.

Stapling processing unit 7 is placed adjacent to the downstream end of the first conveying path 31. Stapling processing unit 7 comprises process tray 70 which tilts so that the upper end is close to discharge roller 43, pick up belt 71 placed along process tray 70, and stapling unit 72 located at the bottom end of process tray 70. Pick up upper paddle 78 is placed at the upside near the upper end of process tray 70. Pick up lower paddle 79 is placed at the upside near the lower end of process tray 70.

[Explanation for Post-processing]

Post-processing on sheet post-processing device 1 is performed, based on control of control unit 10. Control unit 10 performs specified post-processing appropriately, in response to the contents input as executing instructions from a user received by operation unit 111 of the main body of the image forming apparatus 110, or the like. In other words, control unit 10 receives an instruction input from a user by operation unit 111 of the main body of the image forming apparatus 110, via control unit 120 of the main body of the image forming apparatus 110. Control unit 10 controls behavior of sheet post-processing device 1, in response to the received contents. At this time, control unit 10 performs post-processing by using sheet information or the like acquired from the main body of the image forming apparatus 110, as needed basis.

Sheet post-processing device 1 conveys sheets being fed one by one from the main body of the image forming apparatus 110 in series, on conveying paths 21 and 31. Sheet post-processing device 1 directly discharges the sheets on sheet tray 4, or stacks the sheets up on process tray 70. During this time, punch processes by punch processing unit 6 and folding behavior by folding processing unit 8 may be performed, in response to the contents of the instruction input from a user. When sheets are stacked on process tray 70, stapling processing unit 7 performs post-processing on each bundle of a plurality of sheets being stacked on process tray 70, and discharges the sheets.

Punch processing unit 6 executes punching on a sheet by punch unit 37, at the post-processing location or at the location adjacent to the post-processing location, for each sheet being conveyed. The punched sheet may be fed to process trays 70 and 80 or discharged from processing unit main body 3, in response to the other post-processing contents.

Stapling processing unit 7 stacks sheets conveyed on process tray 70 one by one. Stapling processing unit 7 performs side stitching on predetermined number of sheets on stapling unit 72, to make a booklet. The booklet on which side stitching was performed, is discharged onto sheet tray 4.

More specifically, in stapling processing unit 7, sheets fed out one by one from horizontal conveying unit 2 are conveyed toward sheet tray 4. When the posterior end of the sheet passed through pick up roller 42, the drive of pick up upper paddle 78, pick up lower paddle 79, and pick up belt 71 is started, to stack the sheet on process tray 70. In parallel to the sheet stacking behavior, a side stitching adjustment board (which is not shown in the figures) works, to align the sheets in the width direction. In this manner, when the stacking and the alignment for the last sheet in a plurality of sheets in a set of a bundle of sheets are finished, stapling process is performed by stapling unit 72 at the post-processing location or the location adjacent to the post-processing location. When stapling process is completed, discharge roller 43 contacts to the sheets with pressure and is driven, so that the sheets on which stapling process was performed are discharged from process tray 70 to sheet tray 4.

[Explanation which Relates to the Folding Process]

Sheet post-processing device 1 can perform a folding process, as a post-processing, according to the embodiment. The folding process will be explained in the followings.

Figure 4:
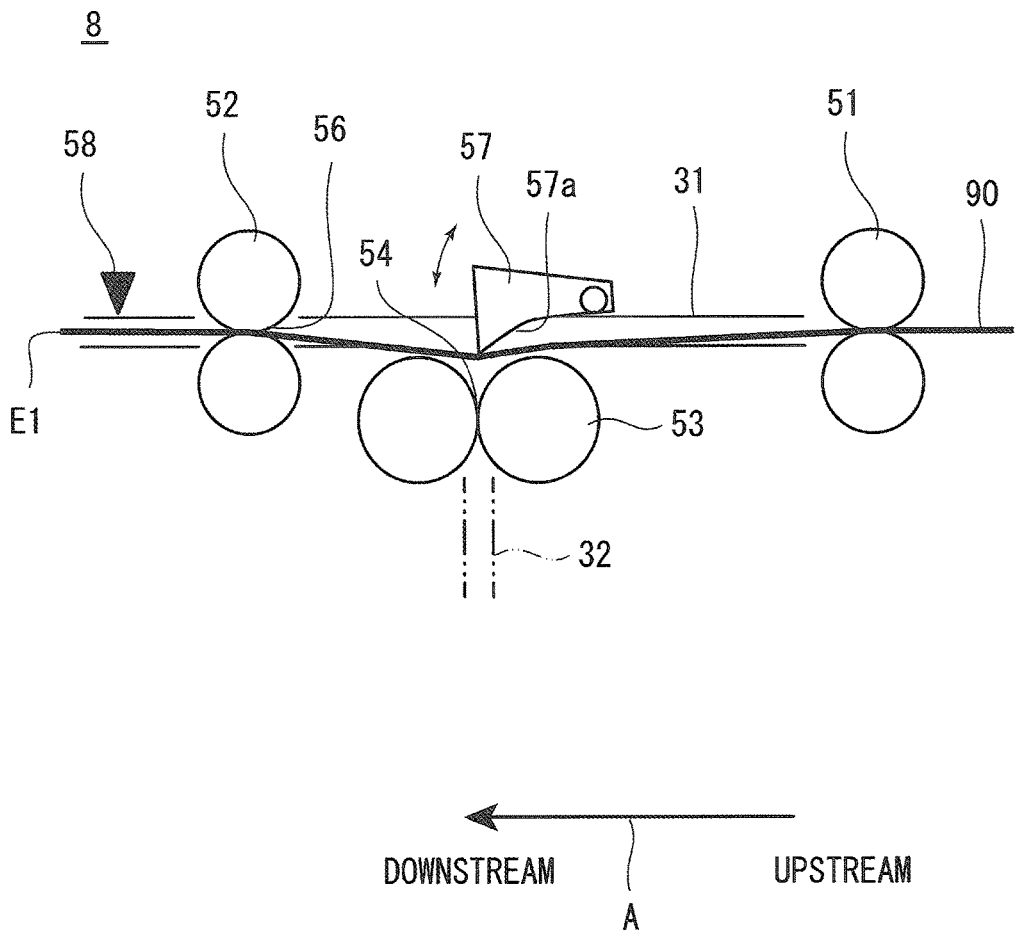
FIG. 4 shows an example of a structure of a folding processing unit, according to the embodiment.

FIG. 4 shows an example of a structure of a folding processing unit 8, according to the embodiment.

In FIG. 4, the arrow "A" shows a conveying direction of sheet 90. More specifically, in FIG. 4, the right-hand direction is an upstream side in the sheet conveying direction, and the left-hand direction is a downstream side in the sheet conveying direction.

In the following explanation, folding behavior in which sheet 90 is folded firstly may be referred to as "the first folding" or "folding 1", and folding behavior in which sheet 90 is folded secondly may be referred to as "the second folding" or "folding 2". The folding location of the first folding on sheet 90 may be referred to as "the first folding position", and the folding location of the second folding on sheet 90 may be referred to as "the second folding position".

Folding processing unit 8 comprises a plurality of pairs of rollers 51, 52, and 53. Upstream side conveying roller 51 is placed at an upstream side along with the first conveying path 31. Upstream side conveying roller 51 conveys sheet 90 fed into folding processing unit 8 on the first conveying path 31. Downstream side conveying roller 52 is placed along with the first conveying path 31, at a downstream side of upstream side conveying roller 51 on the first conveying path 31. Downstream side conveying roller 52 conveys sheet 90 on the first conveying path 31.

Folding roller 53 is placed at the location between upstream side conveying roller 51 and downstream side conveying roller 52 on the first conveying path 31. Folding roller 53 is placed under the first conveying path 31, wherein two rollers are arranged in sheet conveying direction "A" of the first conveying path 31. The place between the two rollers in folding roller 53 is the first nip portion 54 which performs folding behavior on sheet 90.

Folding roller 53 works together with upstream side conveying roller 51 and so on, based on control of control unit 10, to pinch sheet 90 by the first nip portion 54 between the two rollers, and to fold sheet 90. For example, when Z-folding is performed at folding processing unit 8, folding roller 53 performs the first folding on sheet 90, based on control of control unit 10 (an example of the first folding means).

According to the embodiment, downstream side conveying roller 52 is configured to be able to fold sheet 90, pinching sheet 90 at the second nip portion 56 between the rollers, similarly as folding roller 53. More specifically, downstream side conveying roller 52 works together with upstream side conveying roller 51 and so on, based on control of control unit 10, to pinch sheet 90 at the second nip portion 56 and fold sheet 90. For example, when Z-folding is performed at folding processing unit 8, downstream side conveying roller 52 executes the second folding on sheet 90, based on control of control unit 10 (an example of the second folding means). The second nip portion 56 is located at a downstream side of the first nip portion 54, on the first conveying path 31. Hence, the second nip portion 56 can execute the second folding. More specifically, after performing the first folding behavior by using folding roller 53, the second folding behavior is performed by using downstream side conveying roller 52 at the downstream side.

The second conveying path 32 is provided under folding roller 53, branching off from the first conveying path 31, via the first nip portion 54. The leading end folded by folding roller 53 of sheet 90 is fed into the second conveying path 32. In the embodiment, the second conveying path 32 may not have a part or the like which guides sheet 90 fed into the second conveying path 32.

An edge face detection sensor (an example of a detector; hereinafter it may be simply referred to as a sensor) 58 is placed at a downstream side of downstream side conveying roller 52, along the first conveying path 31. Control unit 10 detects an edge face E1 of the leading end of sheet 90 being conveyed in the conveying direction on the first conveying path 31, by using sensor 58 (an example of the first edge face detection means, and an example of the second edge face detection means). As a sensor 58, various sorts of structures can be adopted. For example, sensor 58 which optically detects edge face E1 by using a laser beam or the like can be adopted. Sensor 58 which detects displacement of a lever or the like which moves when interfering with sheet 90 being conveyed on the first conveying path 31 can be adopted, for detecting edge face E1.

Sensor 58 is placed at the location where edge face E1 of sheet 90 can be detected at a downstream side of the first nip portion 54, after sheet 90 was folded by folding roller 53. More specifically, the distance of the conveying path of sheet 90 from sensor 58 to the first nip portion 54 is configured, so that the distance is longer than the distance from edge face E1 to the first folding position of sheet 90 on which normal folding behavior is performed.

According to the embodiment, a pressing member 57 is provided at an upper part of the first conveying path 31. As shown by a double-headed arrow in FIG. 4, pressing member 57 is placed rotatably and swingably with respect to the first conveying path 31. Pressing member 57 is configured to bring the lower end into contact with the upper surface of sheet 90 located in the first conveying path 31, for pressing sheet 90 against the first nip portion 54, in response to the rotational position. When folding behavior using folding roller 53 is performed, control unit 10 moves pressing member 57, to press sheet 90 against the first nip portion 54.

Curved portion 57*a* is formed, on the surface of pressing member 57 viewed from the upstream side of the first conveying path 31. The surface of curved portion 57*a* is formed, for making the sectional side view a curved line convexed upwardly. Curved portion 57*a* is formed, to guide sheet 90 from the first conveying path 31 to the first nip portion 54, so that sheet 90 moves along curved portion 57*a*.

Folding processing unit 8 folds sheet 90 on which images were formed, at two positions, when an execution instruction of a user issued (the folding behavior). For example, so-called Z-folding, or outer threefold is performed as folding behavior. Folding behavior is performed by using size information which was acquired by control unit 10, of sheet 90 on which images were formed by the image forming unit 130. More specifically, control unit 10 determines the location of sheet 90 by using the size information, the detection result of edge face detection sensor 58, and the conveying amount of sheet 90 by conveying rollers 51, 52 or the like, to fold sheet 90 at the predetermined folding positions. Control unit 10 determines the first folding position and the second folding position of sheet 90, based on the detection result of edge face detection sensor 58. Then, control unit 10 controls folding processing unit 8, so that the first folding and the second folding at the deter mined positions are performed on sheet 90.

For example, when Z-folding is performed, folding processing unit 8 works as follows, based on control by control unit 10.

Figure 5:
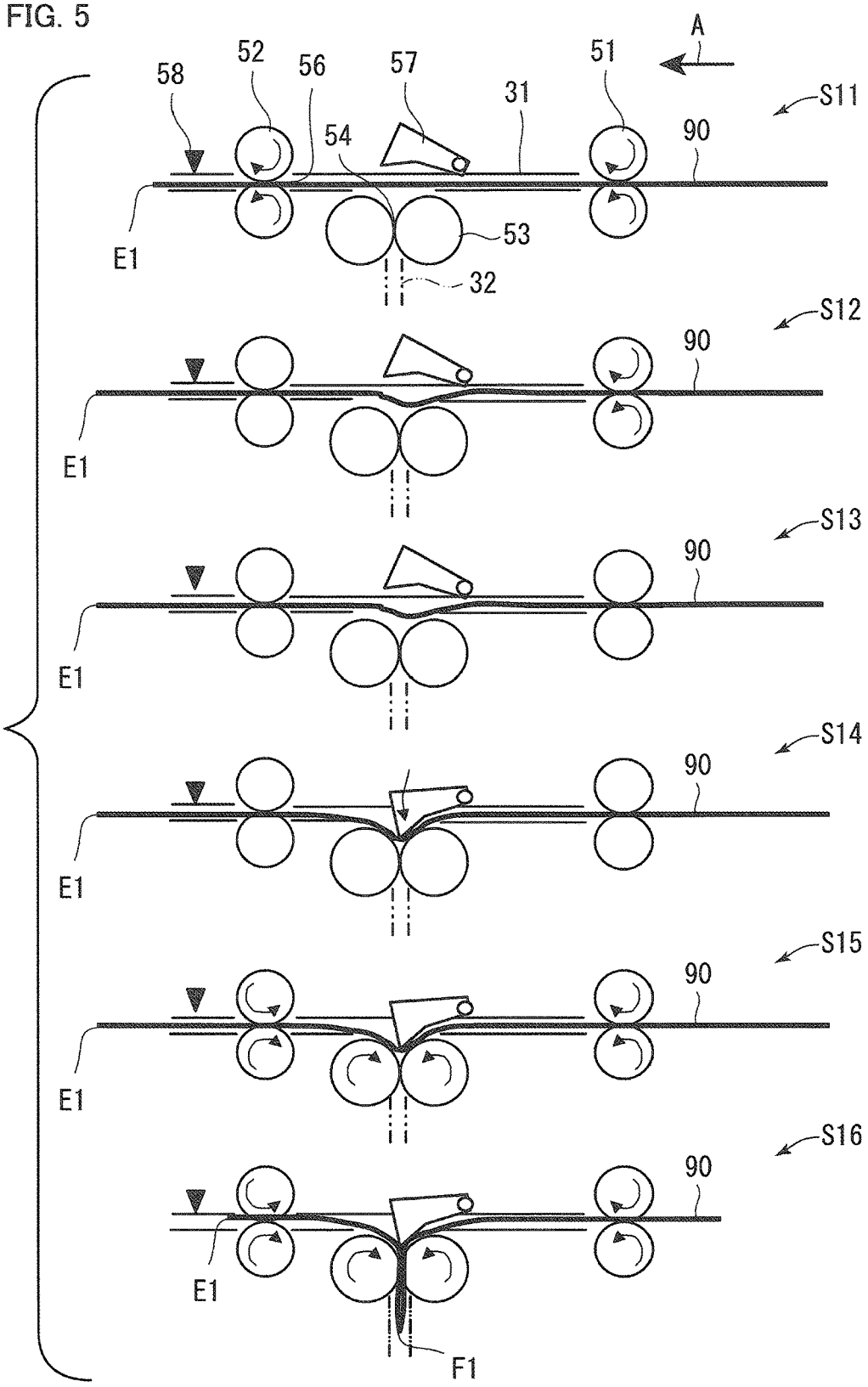
FIG. 5 is the first Figure showing a sequence of behavior of the folding processing unit, when Z-folding is performed.

FIG. 5 is the first Figure showing a sequence of behavior of the folding processing unit 8, when Z-folding is performed.

In FIG. 5, a sequence of behavior to perform the first folding is illustrated. In FIG. 5 and the following Figures, the arrows depicted in rollers indicate that the rollers are rotating in the directions.

Firstly, sheet 90 is conveyed into folding processing unit 8. Sheet 90 is conveyed being pinched by upstream side conveying roller 51, to the downstream side. Sheet 90 is in a state being pinched by downstream side conveying roller 52 too. When edge face E1 of the leading end side reaches sensor 58, sensor 58 detects the edge face E1 (Step S11).

When the leading end of sheet 90 is detected by sensor 58, control unit 10 stops downstream side conveying roller 52, at the predetermined position corresponding to the size of sheet 90 and the folding method to be performed (a folding mode). After downstream side conveying roller 52 stopped, upstream side conveying roller 51 continuously performs the conveying (Step S12). In the first conveying path 31, there is a little space at the top of the first nip portion 54 (a space for a loop). Hence, sheet 90 deflects and is in a state in which the sheet loop is formed, at the space for the loop adjacent to the first nip portion 54, since upstream side conveying roller 51 continues conveying, sheet 90 being pinched by downstream side conveying roller 52.

When predetermined time t1 elapsed after the drive of downstream side conveying roller 52 stops, upstream side conveying roller 51 stops (Step S13). Herewith, sheet 90 temporarily stops, in a state that the sheet loop is formed. The sheet loop was formed only by feeding of upstream side conveying roller 51. Therefore, variation (an error) of the stopping position of the sheet 90 when the sheet 90 stops can be minimized, as compared with variation (an error) of the stopping position of the sheet 90 when sheet 90 is fed by both upstream side conveying roller 51 and downstream side conveying roller 52.

Next, pressing member 57 rotates toward sheet 90. The sheet loop is pushed against the first nip portion 54, by the lower end of pressing member 57 (Step S14). An apex of the sheet loop (the position decided as the first folding position) is located adjacent to the first nip portion 54 of folding roller 53.

Figure 6:
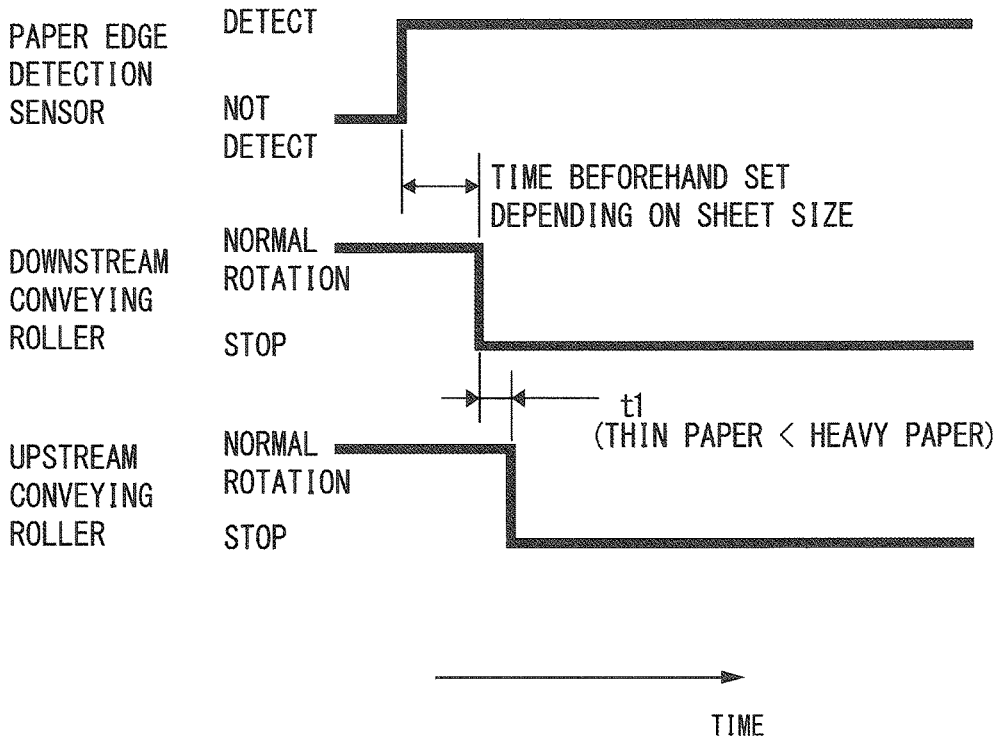
FIG. 6 is a timing chart showing behavior of the folding processing unit, when forming a sheet loop.

FIG. 6 is a timing chart showing behavior of the folding processing unit 8, when forming a sheet loop.

In FIG. 6, behavior of sensor 58, behavior of downstream side conveying roller 52, and behavior of upstream side conveying roller 51 are shown in order from the top row. When edge face E1 of sheet 90 is detected by sensor 58, and the time set beforehand depending on the size of sheet 90 elapsed, control unit 10 firstly stops downstream side conveying roller 52. After that, upstream side conveying roller 51 continues to rotate during time period t1, and upstream side conveying roller 51 stops. The time period t1 is set based on information of sheet 90 by control unit 10. For example, the time period t1 for when performing folding processes on the thin paper is set shorter than the time period t1 for when performing folding processes on the heavy paper.

Namely, an amount (size) of the sheet loop to be formed is adjusted by the time period t1 during which upstream side conveying roller 51 continues conveying after downstream side conveying roller 52 stops, to form the amount of the sheet loop beforehand prescribed, based on types of sheet 90, and information of the basis weight. The size of the sheet loop does not exceed the size of which sheets 90 can bend, in accordance with the space for the loop. Therefore, creases and kinks are not created on sheet 90. When pressing member 57 pushes the sheet loop, the amount of the push is kept sufficiently, with respect to the size of the sheet loop. Then, sheet 90 is fed into the first nip portion 54 suitably.

Referring back to FIG. 5, in a state which pressing member 57 is pushing the sheet loop, control unit 10 rotates upstream side conveying roller 51 and downstream side conveying roller 52 in a direction which sheet 90 is fed into folding roller 53. At the same time, control unit 10 starts up folding roller 53, so that the first nip portion 54 bites the sheet loop (Step S15).

Herewith, the folding line of the first folding is formed at the first folding position F1 (Step S16).

Figure 7:
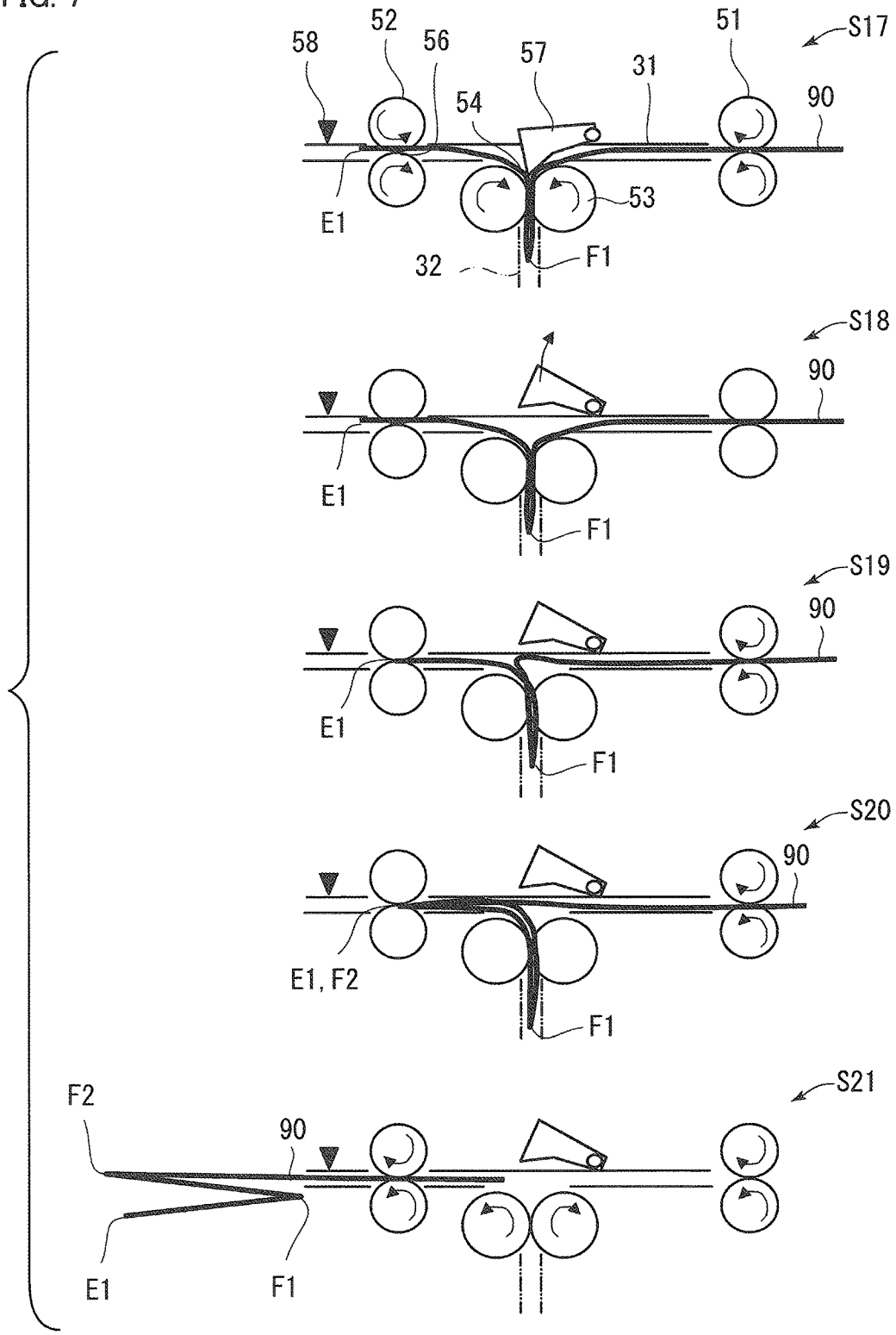
FIG. 7 is the second Figure showing a sequence of behavior of the folding processing unit, when Z-folding is performed.

FIG. 7 is the second Figure showing a sequence of behavior of the folding processing unit 8, when Z-folding is performed.

In FIG. 7, a sequence of behavior from when the first folding was completed to when the second folding is completed is shown.

As shown by FIG. 7, along about when the folding line of the first folding is formed, edge face E1 of sheet 90 moves to an upstream side in a conveying direction, and edge face E1 is again detected by sensor 58 (Step S17). Control unit 10 drives folding roller 53 and so on, till sheet 90 reaches the location corresponding to the size of sheet 90 and the folding mode. After that, control unit 10 stops folding roller 53 and so on.

After stopping folding roller 53 and so on, control unit 10 evacuates pressing member 57 upward, to move pressing member 57 away from sheet 90 (Step S18).

Next, control unit 10 starts up upstream side conveying roller 51, to feed sheet 90 from the upstream side to the downstream side. At this time, downstream side conveying roller 52 and folding roller 53 stop, holding sheet 90. Hence, the sheet loop is created at the upstream side of downstream side conveying roller 52 (Step S19).

At the stage in which the sheet loop grew largely approaching adjacent to the second nip portion 56 of downstream side conveying roller 52 (Step S20), control unit 10 restarts the drive of downstream side conveying roller 52 and folding roller 53, to convey sheet 90. Herewith, the second nip portion 56 of downstream side conveying roller 52 bites the sheet loop, so that the folding line of the second folding is created on the second folding position F2. After that, the rollers 51, 52, and 53 are further driven, so that sheet 90 folded at both the first folding position F1 and the second folding position F2, in a state of Z-folding, is conveyed downstream (Step S21).

Sheet 90 in the Z-folding state conveyed downstream may be stacked directly on sheet tray 4. Post-processing such as stapling, punching, or the like may be performed on sheet 90 in the Z-folding state conveyed downstream.

According to the embodiment, the second folding position F2 at which the second folding is performed is set, based on the detection result of edge face E1 of sheet 90 by sensor 58. Therefore, the error of the second folding position F2 can be decreased, as compared with the conventional technique in which the second folding position F2 is set on the basis of the first folding position F1.

Figure 8:
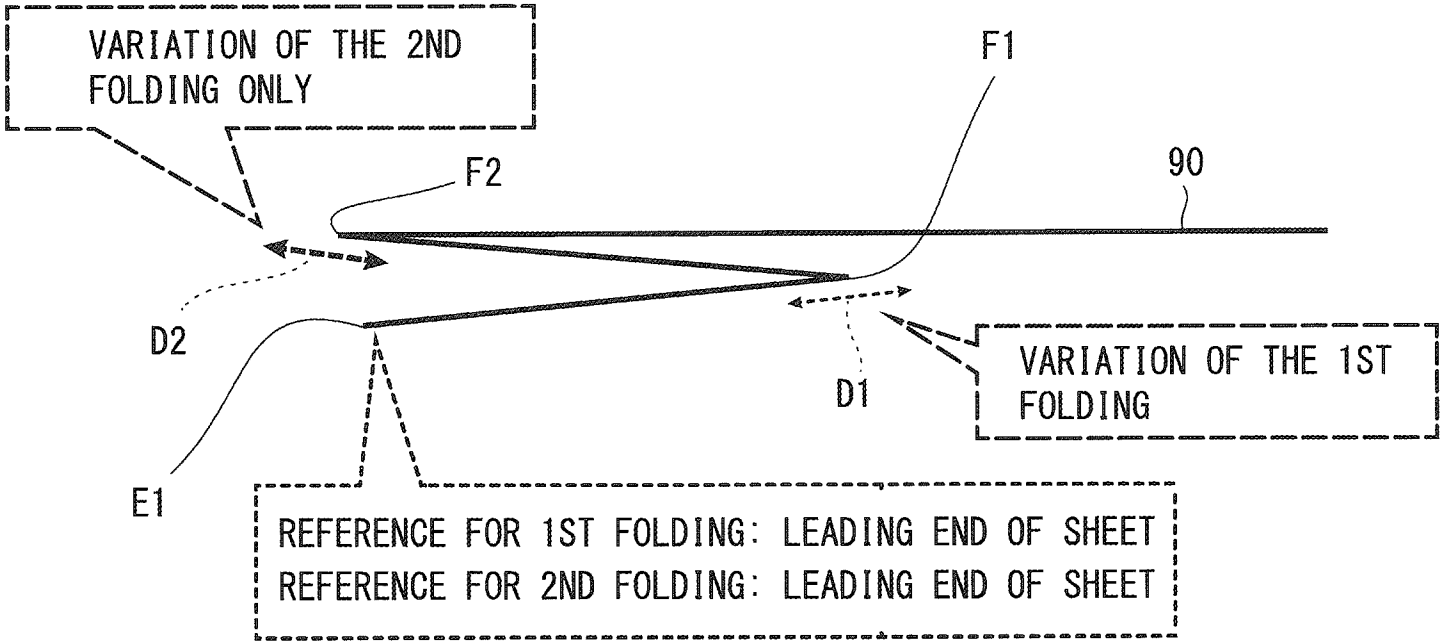
FIG. 8 is for explanation pertaining to an error of the second folding position, according to the embodiment.

FIG. 8 is for explanation pertaining to an error of the second folding position F2, according to the embodiment.

As shown by FIG. 8, according to the embodiment, both the first folding and the second folding are performed on the basis of edge face E1 of the leading end of sheet 90. Therefore, in a state after the process of Z-folding, outer threefold, or the like, an error D2 of the distance from edge face E1 of sheet 90 to the second folding position F2 is unaffected by an error D1 of the distance from edge face E1 of sheet 90 to the first folding position F1, which occurred by the first folding. In other words, an error D2 caused by the second folding is not an accumulated error including an error D1 caused by the first folding. Hence, such post-processing can be performed with precision.

According to the embodiment, sensor 58 is placed at the location where edge face E1 of sheet 90 can be detected after the first folding. When the first folding position is shifted from the assumed location, it can be detected, by detecting edge face E1 of sheet 90 after the first folding. When the first folding position is shifted from the assumed location, control unit 10 may correct the amount of the shift.

Figure 9:
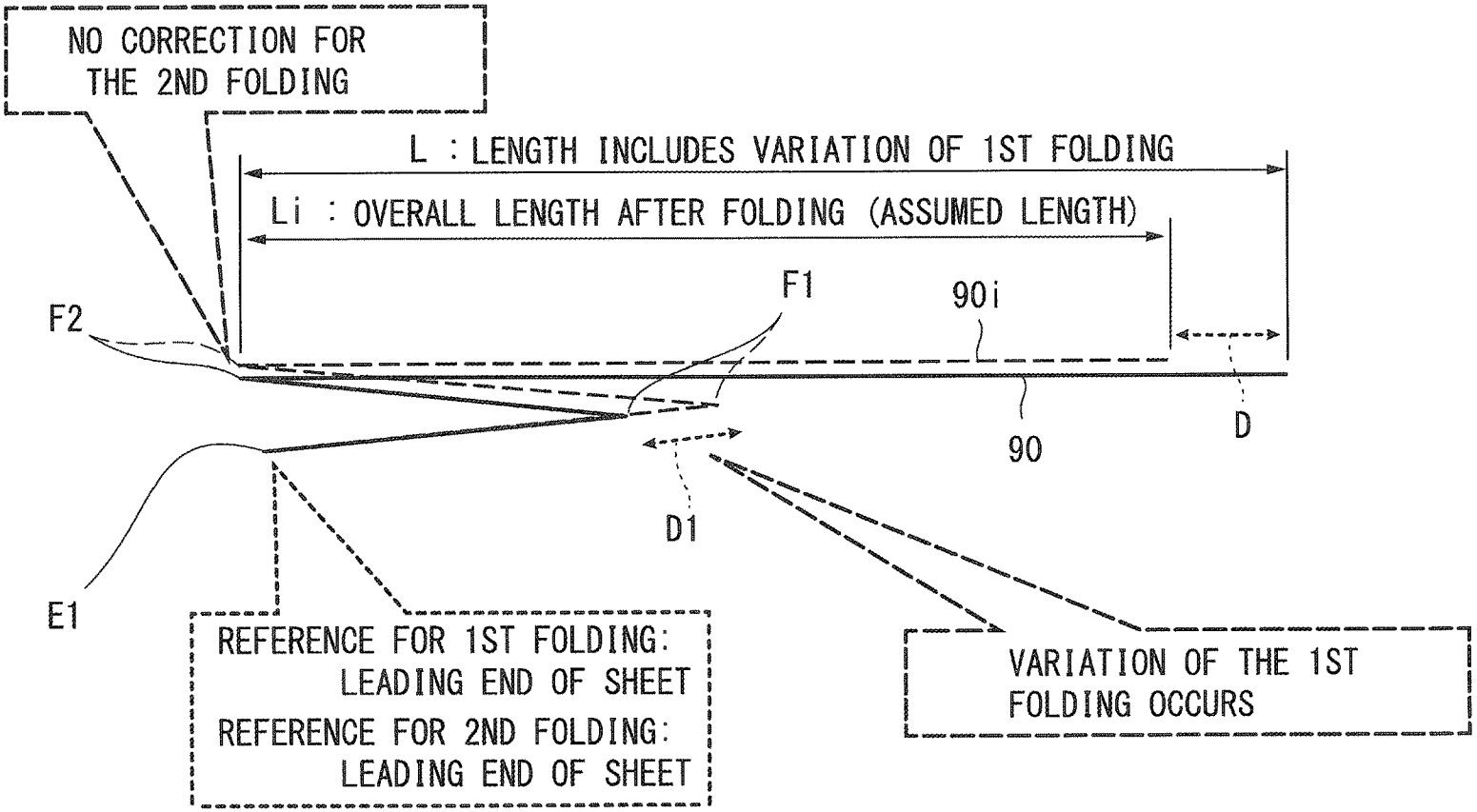
FIG. 9 is for explanation pertaining to the process result, when deviation amount correction is not performed.
Figure 10:
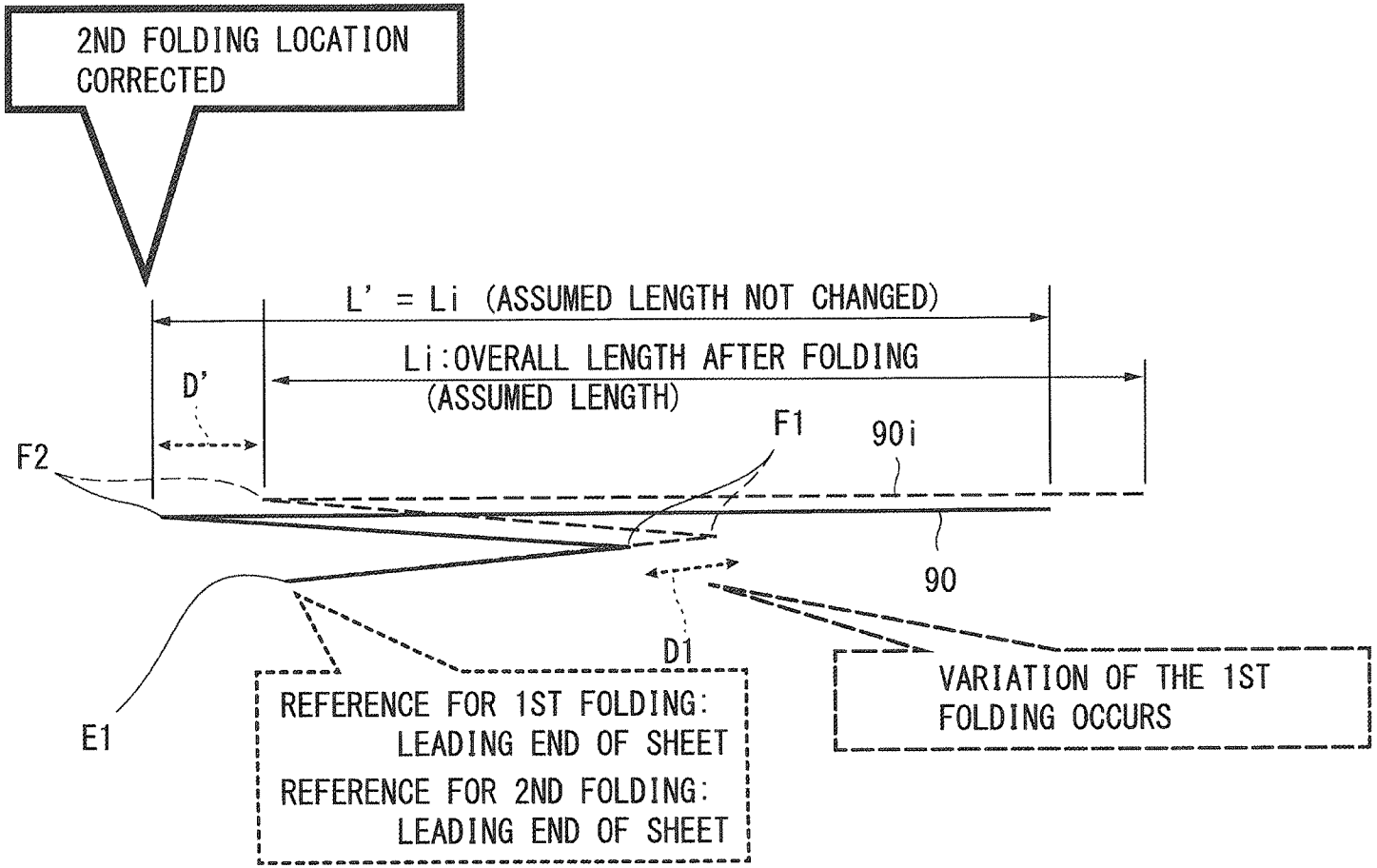
FIG. 10 is for explanation pertaining to the process result, when deviation amount correction is performed.

FIG. 9 is for explanation pertaining to the process result, when deviation amount correction is not performed. FIG. 10 is for explanation pertaining to the process result, when deviation amount correction is performed.

In FIGS. 9 and 10, the broken line shows sheet 90*i* folded ideally (without errors D1, and D2), and the solid line shows sheet 90 in a state which an error D1 occurred at the first folding position F1.

As shown by FIG. 9, when the deviation amount correction in the second folding is not performed, the second folding is performed on the basis of edge face E1 of the leading end of sheet 90. Even though the second folding position was not deviated, when the first folding position F1 was deviated to approach the leading end of sheet 90, the second folding position F2 approaches the leading end of sheet 90 by the deviation amount of the first folding. More specifically, the length from the second folding position F2 to the posterior end of sheet 90 is "L" which includes an error D (which is almost double the error D1) and is longer than length "Li" assumed when the folding process is performed ideally.

On the other hand, when the second folding is performed with deviation amount correction, as shown by FIG. 10, control unit 10 corrects the second folding position F2 by distance D' (for example, a distance almost same as the error D1), based on the error D1 of the first folding position F1, using end face E1 of sheet 90 as a reference. Then, when there is not an error of the second folding position F2, although the distance from edge face E1 of sheet 90 to the second folding position F2 changes in a state that sheet 90 was folded, length L' from the second folding position F2 to the posterior end of sheet 90 is almost same as length Li assumed when the folding process is ideally performed.

Namely, according to the embodiment, the deviation of the distance L which is from the second folding position F2 to the posterior end of sheet 90 can be corrected, wherein the deviation occurred by an error D1 of the first folding position F1 of the first folding. Therefore, when folding processes are performed for a plurality of sheets, each distance L of each sheet 90 can be equalized. For example, the size of sheet 90 after Z-folding is adjusted to assumed distance L. Therefore, when making a booklet including both a sheet which was not folded and a sheet 90 after Z-folding, the booklet looks good.

As presented above, according to the embodiment, control unit 10 decides the first folding position and the second folding position, by using one edge face detection sensor 58. Herewith, the number of sensors can be reduced. Also, the structure of sheet post-processing device 1 can be simplified. However, the number of sensors used in folding processing unit 8 is not limited to one. For example, control unit 10 may detects edge face E1 of sheet 90 to decide the first folding position by using a sensor installed at an upstream side of the first nip portion 54. Control unit 10 may detect edge face E1 of sheet 90 to decide the first folding position by using a sensor (for example, register sensor 35*a* or the like) which is installed at an upstream side of folding processing unit 8.

Folding processing unit 8 may fold sheet 90 at only one position, without performing the second folding, and discharge sheet 90.

Figure 11:
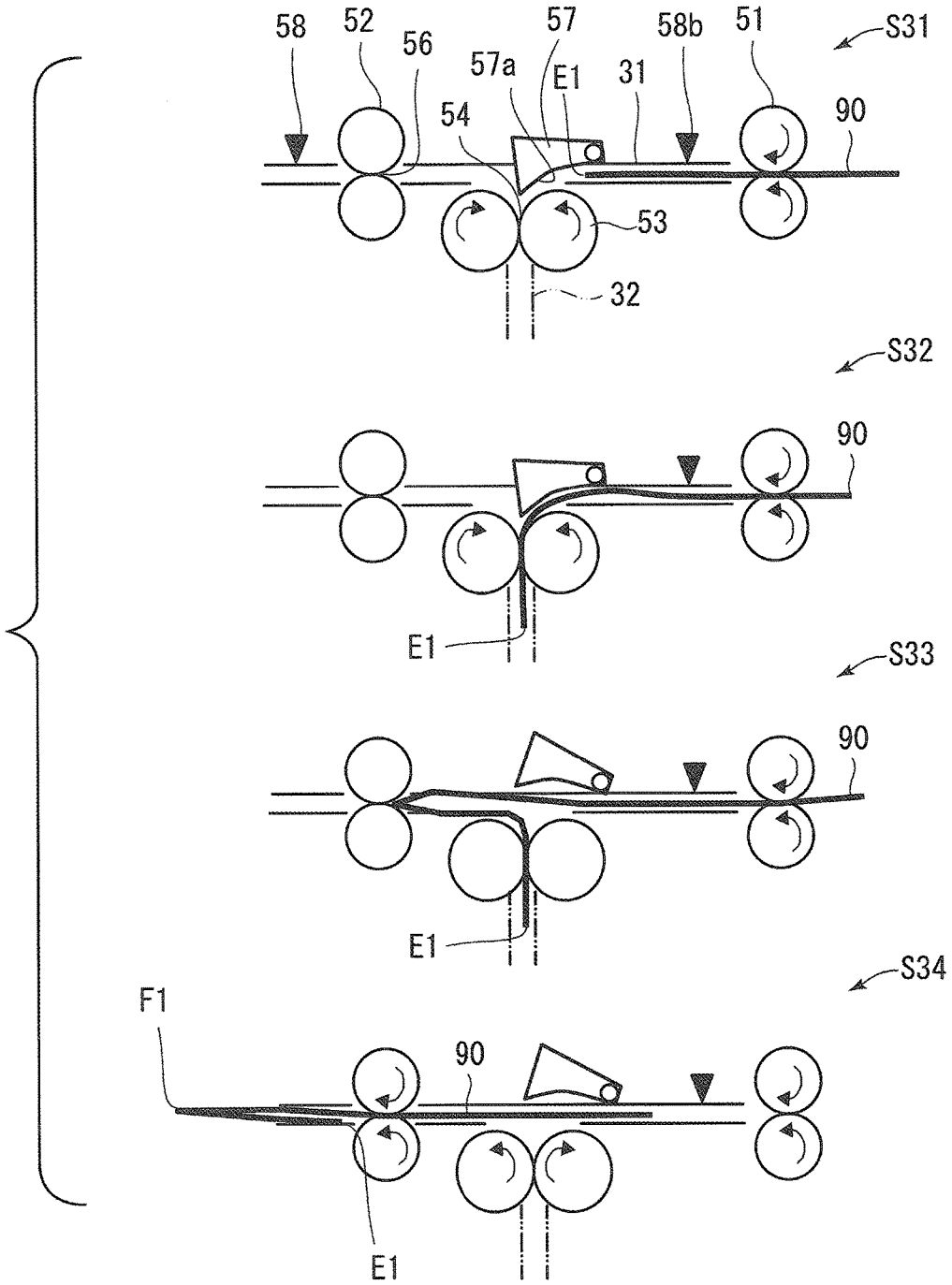
FIG. 11 is for explanation pertaining to behavior of the folding processing unit, when folding at only one position.

FIG. 11 is for explanation pertaining to behavior of the folding processing unit 8, when folding at only one position.

In FIG. 11, in folding processing unit 8, edge face detection sensor 58*b* of an upstream side is placed between upstream side conveying roller 51 and folding roller 53, in addition to edge face detection sensor 58, for example. When folding a sheet at only one position using the structure of folding processing unit 8, sensor 58*b* of the upstream side is used.

As shown by FIG. 11, pressing member 57 firstly moves downward, before sheet 90 is conveyed (Step S31). Since curved portion 57*a* is formed at an upstream side of pressing member 57, a conveying path for guiding sheet 90 from the first conveying path 31 to the first nip portion 54 is temporarily configured.

Upstream side conveying roller 51 and folding roller 53 are driven. Sheet 90 is fed by upstream side conveying roller 51 toward pressing member 57. When edge face E1 of sheet 90 is detected by sensor 58*b*, sheet 90 is further conveyed by a predetermined amount. When edge face E1 of sheet 90 passes through the first nip portion 54, edge face E1 of sheet 90 is fed into the second conveying path 32 (Step S32).

When edge face E1 of sheet 90 is fed into the second conveying path 32, control unit 10 evacuates pressing member 57 upward. After that, when sheet 90 was conveyed by a predetermined amount after edge face E1 of sheet 90 was detected, folding roller 53 stops and sheet 90 is held at the first nip portion 54. Upstream side conveying roller 51 continues conveying sheet 90. Herewith, sheet 90 is deflected in the first conveying path 31, so that the sheet loop is formed before downstream side conveying roller 52 (Step S33).

When the created sheet loop grew to reach the second nip portion 56 of downstream side conveying roller 52, downstream side conveying roller 52 and folding roller 53 rotate in a direction for conveying sheet 90 to the downstream side of the first conveying path 31. Hence, the sheet loop is nipped by the second nip portion 56, to fold sheet 90 at the first folding position F1. The rollers 51, 52, and 53 are driven continuously, so that the sheet folded at the first folding position F1 is conveyed to the downstream side.

According to the behavior, folding processes is performed, so that sheet 90 is folded at only one position.

[Explanation of Modification]

The Structure of rollers for folding a sheet may be modified from the above embodiment.

For example, downstream side conveying roller 52 and the roller for performing the second folding may be different rollers.

Figure 12:
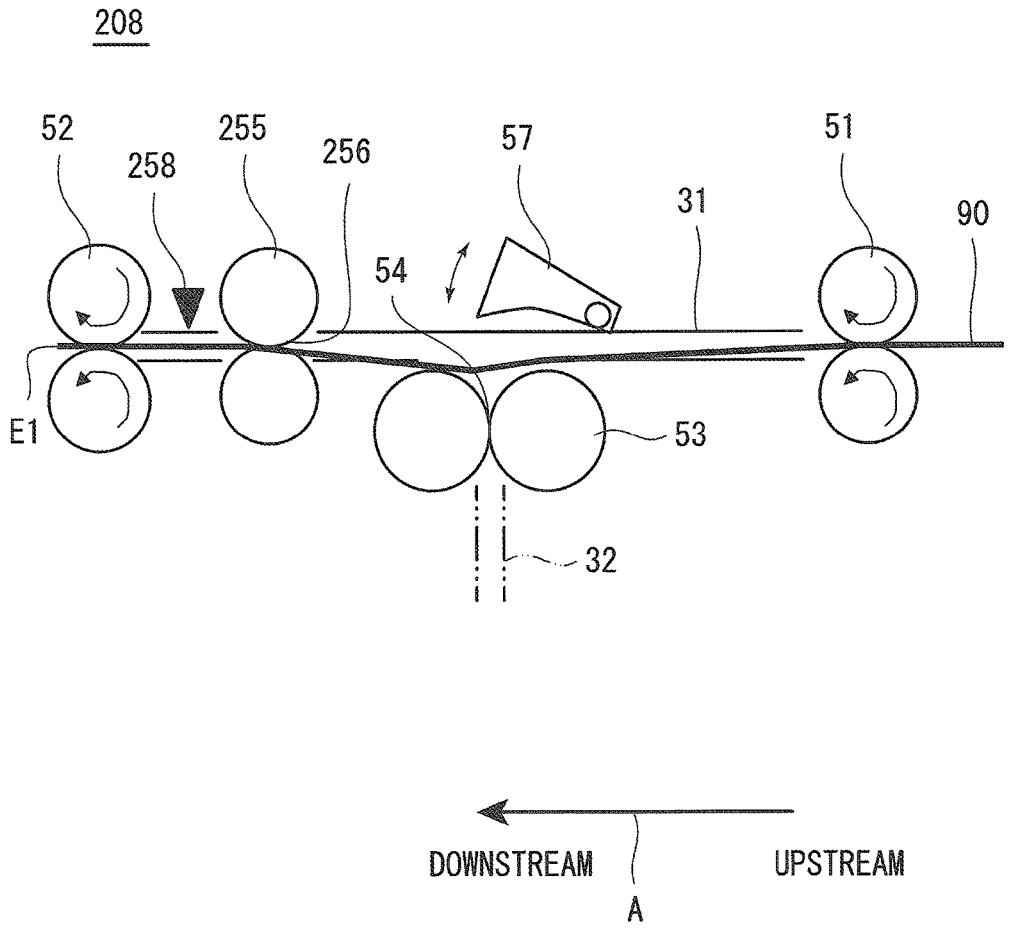
FIG. 12 shows an example of a structure of a folding processing unit installed in a sheet post-processing device, according to the first modification of the embodiment.

FIG. 12 shows an example of a structure of a folding processing unit 208 installed in a sheet post-processing device 1, according to the first modification of the embodiment.

Folding processing unit 208 is different from folding processing unit 8, in the following points mainly. More specifically, as shown by FIG. 12, a pair of the second folding rollers 255 is placed at a downstream side of the first nip portion 54 and at an upstream side of downstream side conveying roller 52. The second nip portion 256 is provided between the second folding rollers 255. As substitute for sensor 58 at a downstream side of downstream side conveying roller 52, edge face detection sensor 258 is placed between the second folding roller 255 and downstream side conveying roller 52.

By such the structure, after the first folding is performed at the first nip portion 54, based on the detection result of edge face detection sensor 258, the second folding is performed at the second nip portion 256 on the basis of edge face E1 of sheet 90.

Figure 13:
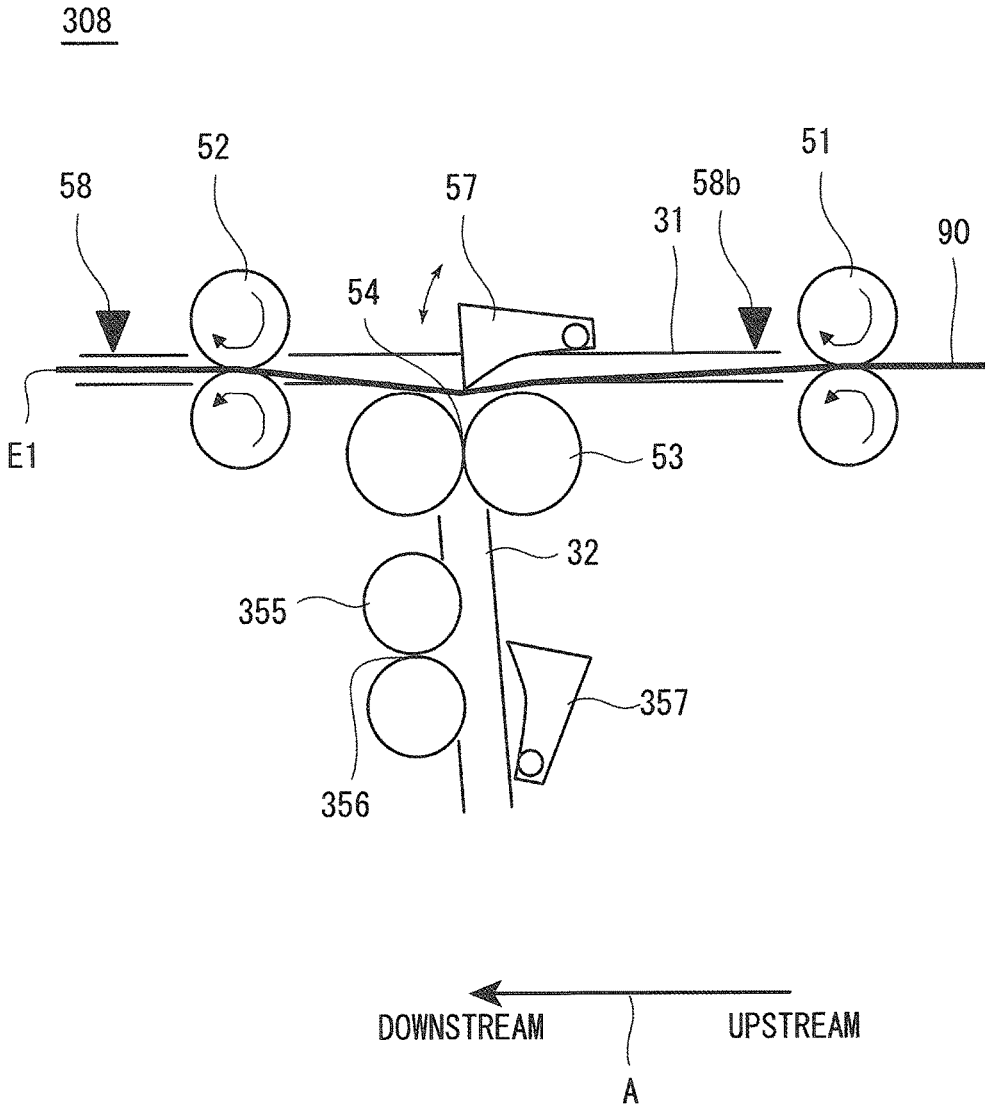
FIG. 13 shows an example of a structure of a folding processing unit installed in a sheet post-processing device, according to the second modification of the embodiment.

FIG. 13 shows an example of a structure of a folding processing unit 308 installed in a sheet post-processing device 1, according to the second modification of the embodiment.

Folding processing unit 308 is different from folding processing unit 8, in the following points mainly. More specifically, as shown by FIG. 13, in the second conveying path 32, a pair of the second folding rollers 355 is placed. The second nip portion 356 is provided between the second folding rollers 355. Pressing member 357 is provided along with the second conveying path 32, for feeding a sheet into the second nip portion 356. In addition to sensor 58 at a downstream side of downstream side conveying roller 52, edge face detection sensor 58*b* is placed, between the first nip portion 54 and upstream side conveying roller 51.

By such the structure, after the first folding is performed at the first nip portion 54, based on the detection result of edge face detection sensor 58, the second folding is performed at the second nip portion 356 on the basis of edge face E1 of sheet 90. At a downstream side (the bottom side of the Figure) of the second conveying path 32, rollers or a stopper (which are not shown in the figures) are provided for holding sheet 90 appropriately at the proper location, to bend sheet 90 in a space for a loop adjacent to the second nip portion 356. Herewith, when folding a sheet at the second position as well as folding the sheet at the first position, sheet 90 temporarily stops and the loop is pushed into the second nip portion 356 by the provided pressing member 357.

According to folding processing unit 308, in addition to Z-folding and outer threefold, inner threefold can be performed by changing the first folding position F1. In such a case, edge face E1 of sheet 90 can be detected by sensor 58 when the first folding is performed, and the second folding can be performed based on the detection result.

Figure 14:
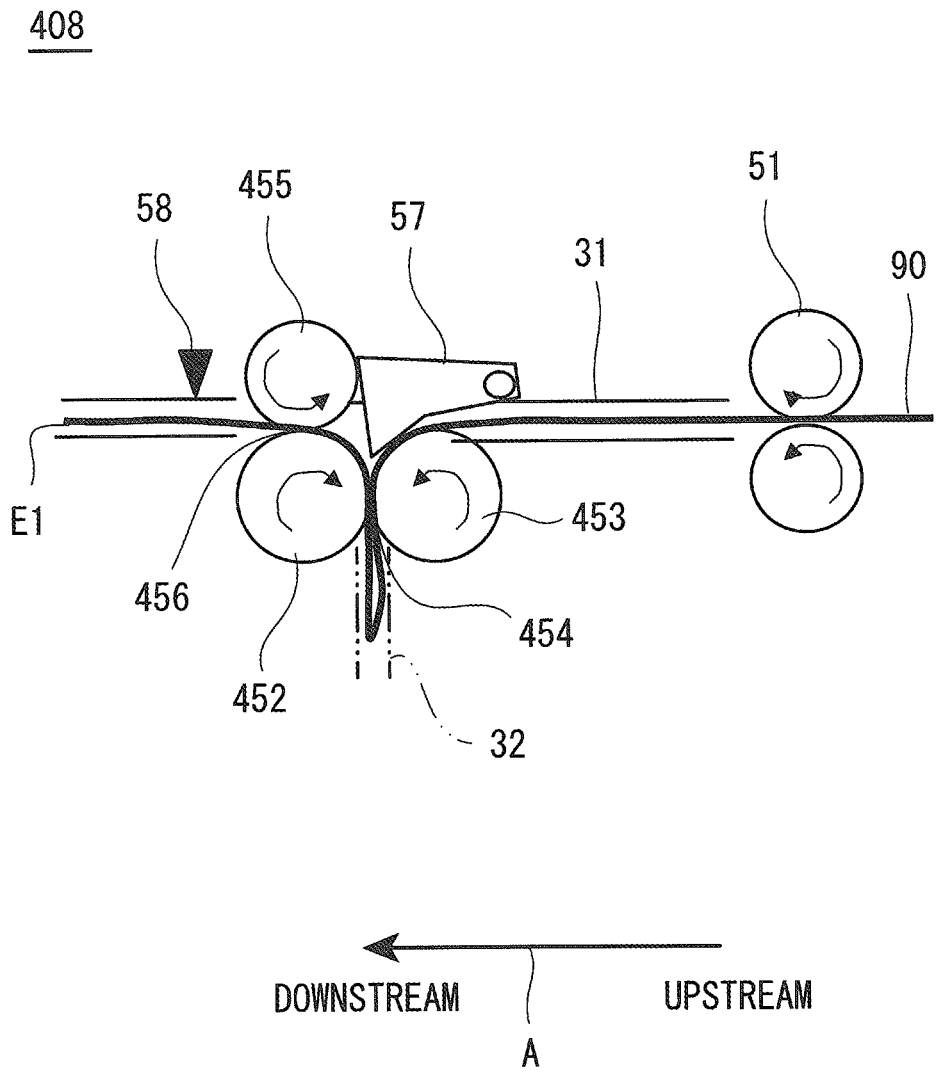
FIG. 14 shows an example of a structure of a folding processing unit installed in a sheet post-processing device, according to the third modification of the embodiment.
Figure 15:
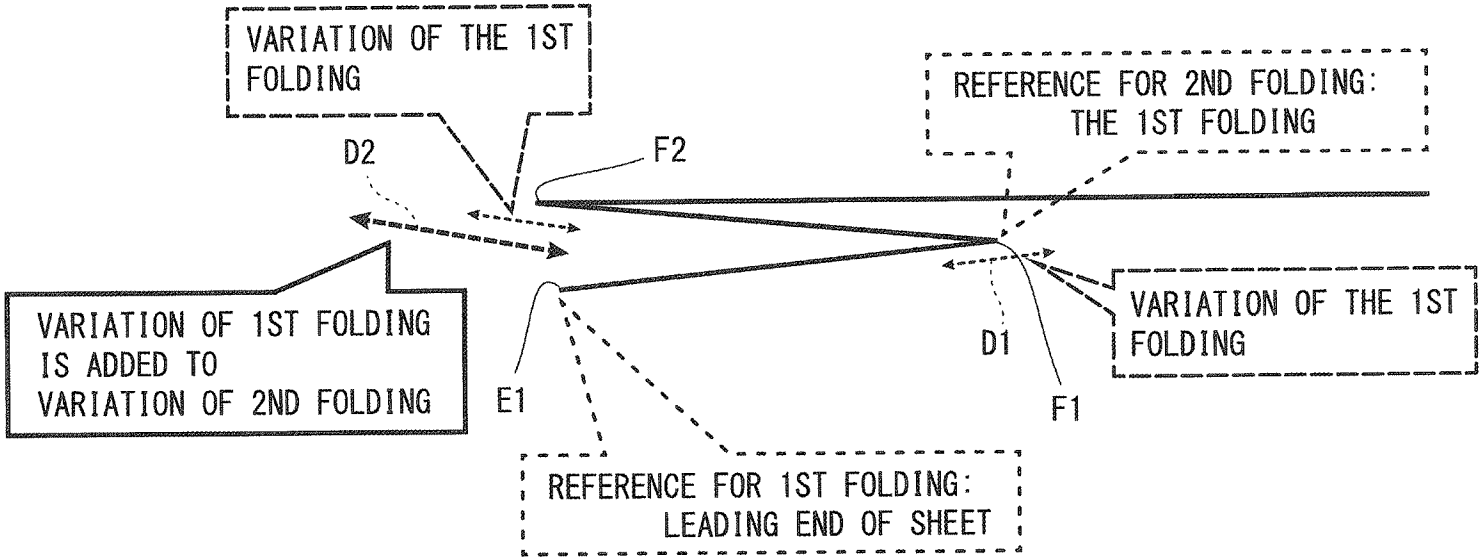
FIG. 15 is for explanation pertaining to an error of the folding position, when Z-folding is performed conventionally.

FIG. 14 shows an example of a structure of a folding processing unit 408 installed in a sheet post-processing device 1, according to the third modification of the embodiment.

Folding processing unit 408 is different from folding processing unit 8, in the following points mainly. More specifically, as shown by FIG. 14, three rollers 452, 453, and 455 are provided at a downstream side of upstream side conveying roller 51 in the first conveying path 31. The first nip portion 454 for performing the first folding is configured by the first roller 452 and the second roller 453. The first roller 452 and the third roller 455 work for the function of downstream side conveying roller 52 and the function of a folding roller for performing the second folding of the above embodiment. More specifically, the second nip portion 456 is configured with the first roller 452 and the third roller 455. Edge face detection sensor 58 is placed at a downstream side of the first roller 452.

More specifically, according to folding processing unit 408, the second folding is performed, by pinching sheet 90 for which the first folding was performed, by the second nip portion 456 between the first roller 452 which is one of two rollers 452 and 453 which are used for performing the first folding, and the third roller 455 which is not used for performing the first folding.

By such the structure, after the first folding is performed at the first nip portion 454, based on the detection result of edge face detection sensor 58, the second folding is performed at the second nip portion 456 on the basis of edge face E1 of sheet 90. In folding processing unit 408, since the number of used rollers is small, sheet post-processing device 1 can be downsized. Further, since deflection of sheet 90 can be decreased, degree of accuracy of the folding position can be improved, for a variety of sheets 90.

[Effect of the Embodiment]

As explained above, according to the embodiment, the second folding is performed by using edge face E1 of sheet 90 as a reference. Hence, even though the error of the first folding position F1 occurred at downstream side conveying roller 52 when the first folding is performed, the error is not accumulated in an error of the second folding position F2. Therefore, such post-processing can be performed with precision.

[Others]

The design and structure of rollers for conveying a sheet and rollers for folding a sheet are not limited to the above mentioned embodiments. The number of edge face detection sensors and the location can appropriately be changed, as long as the above mentioned folding process can be performed. For example, an edge face detection sensor for detecting an edge face of a sheet to perform the second folding may be installed at a downstream side of the first nip portion and an upstream side of the roller to perform the second folding.

The pressing member may be omitted.

The sheet post-processing device may be configured, so that contact pressure between rollers can be changed, for a pair of rollers to form the first nip portion or the second nip portion for folding a sheet. For example, by using mechanisms such as a cam mechanism, solenoids, or the like, the axis of rotation of the roller may be displaced. By using mechanisms such as a earn mechanism, solenoids, or the like, the force to hold the axis of rotation may be changed. When folding behavior is not performed, the contact pressure may be decreased or the rollers are separated, so that electric power consumption is reduced in the sheet post-processing device, and consumption of the rollers can be reduced. The contact pressure can be changed, based on control of control unit 10, for example.

In the above mentioned embodiment and the modification, information used for control of the control unit can be used for various purposes other the above.

The control unit in the main body of the image forming apparatus may control post-processing. In this instance, it can be said that a control unit of an image forming apparatus as a sheet post-processing device controls post-processing.

An image forming apparatus may be configured, wherein a sheet post-processing device and the main body of the image forming apparatus are installed in a same chassis.

A plurality of sheet cartridges may be installed. Plural kinds of sheets of which the types (for example, the types of basis weight, paper quality, or the like) and the sizes are different with each other may be loaded on paper feeding cartridges respectively. In this instance, an image forming apparatus can form images on sheets loaded on the paper feeding cartridge specified by a user, or on sheets loaded on the paper feeding cartridge automatically specified by the control unit in the main body of the image forming apparatus. In this instance, information of basis weight of sheets loaded on each paper feeding cartridge may be input beforehand by a user, on the main body of the image forming apparatus or sheet post-processing device, in connection with each paper feeding cartridge. In this instance, to perform post-processing suitably, the sheet post-processing device receives information of basis weight or the like, for the sheets on which post-processing is to be performed, from the control unit or the main body of the image forming apparatus. The sheet post-processing device performs control based on the received information. The sheet post-processing device may acquire information related to the paper feeding cartridge corresponding to sheets to be conveyed.

The main body of the image forming apparatus may be a copying machine, a printer, a facsimile device, the multi-function peripheral (MFP) for performing such functions, or the like, of black-and-white/color. The main body of the image forming apparatus is not limited to an apparatus which forms images using electrophotographic technology. The main body of the image forming apparatus may form images by so-called an ink jet method, for example.

The processes of above embodiments may be performed by software or a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to a device via communication lines like the internet. The processes explained in the above flowcharts and the description are executed by a CPU in line with the program.

[Effect of the Embodiment]

According to the embodiment, a sheet which was folded at the first nip portion is further folded, based on the detection result of an edge face of a sheet at a downstream side of the first nip portion, by pinching the sheet in the second nip portion at the location of a downstream side of the first nip portion on the first conveying path or at the location on the second conveying path. Therefore, a sheet post-processing device and an image forming apparatus which perform folding behavior with precision can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet post-processing device which folds a sheet conveyed, at two or more positions, comprising:

a first conveying path on which the sheet is conveyed, an upstream side conveying roller installed along the first conveying path, for conveying the sheet, a downstream side conveying roller installed at a downstream side of the upstream side conveying roller on the first conveying path, along the first conveying path, for conveying the sheet, an edge face detection unit for detecting a leading edge face of the sheet being conveyed on the first conveying path, a first folding unit for folding the sheet by pinching the sheet at a first nip portion between two rollers, at a location between the upstream side conveying roller and the downstream side conveying roller on the first conveying path, based on the detection result of the edge face detection unit, a second conveying path to which a folded leading end of the sheet folded by the first folding unit is fed, wherein the second conveying path is installed branching off from the first conveying path, and a second folding unit for further folding the sheet by pinching the sheet folded by the first folding unit, at a second nip portion between two rollers, at a location on a downstream side of the first nip portion on the first conveying path or at a location on the second conveying path, based on a detection result of the leading edge face at a downstream side of the first nip portion on the first conveying path.

2. The sheet post-processing device according to claim 1, wherein the second folding unit decides a folding position of the sheet based on the detection result of the leading edge face at a downstream side of the first nip portion on the first conveying path.

3. The sheet post-processing device according to claim 1, wherein the downstream side conveying roller can convey the sheet by using a pair of rollers, and the second folding unit folds the sheet by pinching the sheet folded by the first folding unit at the second nip portion of the pair of rollers of the downstream side conveying roller.

4. The sheet post-processing device according to claim 1, wherein the second folding unit folds the sheet by pinching the sheet folded by the first folding unit at the second nip portion between one of two rollers used by the first folding unit and a roller which is different from the two rollers used by the first folding unit.

5. The sheet post-processing device according to claim 1, wherein the sheet post-processing device performs Z-folding or outer threefold by folding the conveyed sheet at two positions, and the leading edge face is detected at the downstream side of the first nip portion on the first conveying path by using the edge face detection unit.

6. The sheet post-processing device according to claim 1, further comprising:

a pressing member to press the sheet located on the first conveying path to the first nip portion, wherein the pressing member includes a curved portion formed, where the sheet can be located alongside, to guide the sheet from the first conveying path toward the first nip portion.

7. The sheet post-processing device according to claim 1, wherein the leading edge face of the sheet folded by the first folding unit is detected at the downstream side of the first nip portion on the first conveying path.

8. An image forming apparatus comprising:

a receiving unit for receiving an execution instruction for folding behavior from a user, an image forming unit for forming images on a sheet, and a sheet post-processing device for folding the sheet on which images were formed by the image forming unit, at least at two positions, based on the execution instruction received by the receiving unit, wherein the sheet post-processing device comprises:

an acquire unit for acquiring size information of the sheet on which images were formed by the image forming unit, a first conveying path on which the sheet is conveyed, an upstream side conveying roller installed along the first conveying path for conveying the sheet, a downstream side conveying roller installed at a downstream side of the upstream side conveying roller on the first conveying path along the first conveying path for conveying the sheet, an edge face detection unit for detecting a leading edge face of the sheet being conveyed on the first conveying path, a first folding unit for folding the sheet by pinching the sheet at a first nip portion between two rollers at a location between the upstream side conveying roller and the downstream side conveying roller on the first conveying path based on the detection result of the edge face detection unit and the size information acquired by the acquire unit, a second conveying path to which a folded leading end of the sheet folded by the first folding unit is fed, wherein the second conveying path is installed branching off from the first conveying path, and a second folding unit for further folding the sheet by pinching the sheet folded by the first folding unit at the second nip portion between two rollers at a location on a downstream side of the first nip portion on the first conveying path or at a location on the second conveying path based on a detection result of the leading edge face at a downstream side of the first nip portion on the first conveying path and the size information acquired by the acquire unit.

* * * * *